US011535425B2

(12) United States Patent
Ahlström et al.

(10) Patent No.: US 11,535,425 B2
(45) Date of Patent: Dec. 27, 2022

(54) COOLER

(71) Applicant: Dometic Sweden AB, Solna (SE)

(72) Inventors: Joakim Ahlström, Täby (SE); Samuele Meda, Solna (SE)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 15/819,950

(22) Filed: Nov. 21, 2017

(65) Prior Publication Data

US 2018/0141718 A1 May 24, 2018

Related U.S. Application Data

(60) Provisional application No. 62/425,288, filed on Nov. 22, 2016.

(51) Int. Cl.
*B65D 25/20* (2006.01)
*F25D 3/00* (2006.01)
(Continued)

(52) U.S. Cl.
CPC ..... *B65D 25/20* (2013.01); *A45C 11/20* (2013.01); *A45F 3/46* (2013.01); *B65D 25/2841* (2013.01);
(Continued)

(58) Field of Classification Search
CPC ..... B65D 25/20; B65D 81/3813; B65D 25/2841; F25D 25/022; F25D 23/028;
(Continued)

(56) References Cited

U.S. PATENT DOCUMENTS 2,734,353 A 2/1956 Hill
3,894,405 A 7/1975 Mielitz
(Continued)

FOREIGN PATENT DOCUMENTS

AU 201712770 5/2017
AU 201712799 5/2017
(Continued)

OTHER PUBLICATIONS

European Design Patent Application No. 003847557-0001 entitled "Smart Cooler" filed on Apr. 7, 2017.
(Continued)

*Primary Examiner* — Anthony D Stashick
*Assistant Examiner* — James M Van Buskirk
(74) *Attorney, Agent, or Firm* — Middleton Reutlinger

(57) ABSTRACT

A cooler is provided which has various improvements. The cooler may be a passive cooler or may be actively cooled for providing desirable cooling effects. The cooler may include an accessory system, for example, with bottle or can holders or a post holder which utilizes the weight of the cooler to support a sunshade. The accessory system may be positioned in various locations of the cooler, one location being in a recess which is utilized to open the cooler lid. The smart cooler may also comprise a cushion assembly which may be placed on an upper surface of the lid and may have straps to retain the cushion on the lid. The lid may be formed to accept and retain a cushion retaining feature so that the cushion does not excessively move from the top surface of the lid.

22 Claims, 13 Drawing Sheets

(51) Int. Cl.

| | |
|---|---|
| ***B65D 25/28*** | (2006.01) |
| ***B65D 81/38*** | (2006.01) |
| ***A45F 3/46*** | (2006.01) |
| ***A45C 11/20*** | (2006.01) |
| ***F25D 3/08*** | (2006.01) |
| ***F25D 3/10*** | (2006.01) |
| ***F25D 23/02*** | (2006.01) |
| ***F25D 25/02*** | (2006.01) |

(52) U.S. Cl.
CPC ..... *B65D 81/3813* (2013.01); *F25D 3/00* (2013.01); *F25D 3/08* (2013.01); *F25D 3/105* (2013.01); *F25D 23/028* (2013.01); *F25D 25/022* (2013.01); *F25D 2400/12* (2013.01)

(58) Field of Classification Search
CPC ... F25D 3/105; F25D 3/08; F25D 3/00; F25D 2400/12; A45C 11/20; A45F 3/46
USPC ..... 220/592.1, 23.83, 915.2
See application file for complete search history.

(56) References Cited

U.S. PATENT DOCUMENTS 4,024,731 A 5/1977 Branscum
4,089,467 A 5/1978 Makowicki
4,403,929 A 9/1983 Nagasaku et al.
D272,976 S 3/1984 Lalumiere
D281,695 S 12/1985 Ryan, Jr.
4,637,222 A 1/1987 Fujiwara et al.
4,708,598 A 11/1987 Sugita et al.
4,889,257 A * 12/1989 Steffes ..... A45C 5/00 220/815
D337,019 S 7/1993 Newnan
D337,232 S 7/1993 Kahl
5,226,294 A 7/1993 Mayer
5,407,218 A 4/1995 Jackson
D374,772 S 10/1996 Hotaling et al.
5,676,296 A 10/1997 Masters
5,683,097 A 11/1997 Fenton et al.
5,738,238 A 4/1998 Yang
D400,053 S 10/1998 Coffee et al.
5,860,281 A 1/1999 Coffee et al.
5,890,613 A * 4/1999 Williams ..... A45C 7/0045 220/23.4
D416,447 S 11/1999 Levy et al.
6,079,599 A 6/2000 Nordstrom et al.
D429,606 S 8/2000 Israel et al.
D429,966 S 8/2000 Israel et al.
D451,765 S 12/2001 Israel et al.
D452,406 S 12/2001 Schroeder et al.
D454,292 S 3/2002 Plummer et al.
6,398,272 B1 6/2002 Plummer et al.
6,474,097 B2 11/2002 Treppedi et al.
D494,021 S 8/2004 Huthmaker
D497,517 S 10/2004 Reuter
D500,057 S 12/2004 Reuter
6,938,791 B2 9/2005 Robertson et al.
D512,039 S 11/2005 Kim et al.
7,082,380 B2 7/2006 Weibe et al.
D527,225 S 8/2006 Krieger et al.
7,140,507 B2 * 11/2006 Maldonado ..... A45C 11/20 220/592.2
7,143,601 B1 12/2006 Jimenez
D534,771 S 1/2007 Zorn
D545,633 S 7/2007 Hussaini et al.
7,254,956 B2 8/2007 Matonog et al.
D566,479 S 4/2008 Kabalin
D566,633 S 4/2008 Kanno et al.
7,389,608 B1 * 6/2008 MacKay ..... A01K 97/20 206/315.11
7,392,737 B2 7/2008 Mayorca
7,415,794 B1 8/2008 Thompson
7,540,364 B2 6/2009 Sanderson
D597,366 S 8/2009 Drake et al.
D603,664 S 11/2009 Roefs et al.
7,722,204 B1 5/2010 Sandberg
7,878,013 B2 2/2011 Matsuno et al.
7,913,849 B2 3/2011 Pedrazzi et al.
7,984,997 B1 7/2011 Sandberg
D642,830 S 8/2011 Buckles et al.
D646,528 S 10/2011 Stallman et al.
D647,355 S 10/2011 Ponzio et al.
D649,393 S 11/2011 Cohlmia et al.
D652,262 S 1/2012 Yang et al.
8,104,800 B2 1/2012 Lorek
8,210,702 B1 7/2012 Sandberg
8,312,816 B2 11/2012 Vaccarella
8,356,712 B2 1/2013 Piazza, Jr.
8,511,846 B1 8/2013 Sandberg
8,740,010 B1 * 6/2014 Page ..... A45C 11/20 220/592.03
D712,720 S 9/2014 Seiders
D712,721 S 9/2014 Seiders
D712,722 S 9/2014 Seiders
D712,723 S 9/2014 Seiders
D714,125 S 9/2014 Seiders
8,910,819 B2 12/2014 Seiders
8,939,476 B2 1/2015 Tang
D722,474 S 2/2015 Seiders
D722,475 S 2/2015 Seiders
D727,134 S 4/2015 Yamamoto et al.
D732,348 S 6/2015 Seiders et al.
D732,349 S 6/2015 Seiders et al.
D732,350 S 6/2015 Seiders et al.
D732,899 S 6/2015 Seiders et al.
9,052,131 B2 6/2015 Reimann et al.
9,139,352 B2 9/2015 Seiders et al.
D740,100 S 10/2015 Alfredsson
9,163,871 B1 10/2015 Costello
D743,773 S 11/2015 Shah et al.
9,187,232 B2 11/2015 Seiders
9,220,250 B1 12/2015 Davis
D747,950 S 1/2016 Jacobsen et al.
D747,951 S 1/2016 Jacobsen et al.
9,232,290 B2 1/2016 Besay
D748,452 S 2/2016 Jacobsen et al.
D750,953 S 3/2016 Jacobsen et al.
D752,347 S 3/2016 Seiders et al.
9,282,797 B1 * 3/2016 Soto ..... A45C 13/30
9,297,548 B2 3/2016 Mijanovic et al.
9,320,938 B1 4/2016 Belmore
D756,513 S 5/2016 Cheney
D759,590 S 6/2016 Wang
9,366,467 B2 6/2016 Kiedaisch et al.
D779,306 S 2/2017 Finkelstein et al.
9,605,443 B2 3/2017 Shah et al.
D792,486 S 7/2017 Li et al.
D802,028 S 11/2017 Li
D802,029 S 11/2017 Li
D802,630 S 11/2017 Li et al.
9,828,137 B2 11/2017 Albert et al.
9,878,841 B2 * 1/2018 Holderness ..... B67D 3/0067
D820,049 S 6/2018 Ahlstrom
D826,027 S 8/2018 Carey et al.
D835,552 S 12/2018 Goodrich et al.
D835,948 S 12/2018 Jacobsen
D836,402 S 12/2018 Jacobsen
D836,993 S 1/2019 Meda et al.
D836,994 S 1/2019 Meda et al.
D844,386 S 4/2019 Ahlström et al.
D844,412 S 4/2019 Von Holzhausen et al.
D850,839 S 6/2019 Hardy et al.
D857,559 S 8/2019 Hein et al.
D861,415 S 10/2019 Seiders et al.
10,429,116 B2 * 10/2019 Huish ..... A45C 11/20
D887,788 S 6/2020 Meda et al.
D888,503 S 6/2020 Meda et al.
D933,449 S 10/2021 Ahlström
2004/0178208 A1 9/2004 Leba et al.
2005/0263527 A1 12/2005 Maldonado et al.
2006/0169691 A1 8/2006 Rothschild
2007/0193297 A1 8/2007 Wilson

(56) References Cited

U.S. PATENT DOCUMENTS

| | | | |
|---|---|---|---|
| 2009/0139245 | A1 | 6/2009 | Blackway et al. |
| 2009/0314018 | A1 | 12/2009 | Burchill et al. |
| 2010/0251750 | A1 | 10/2010 | Lifson et al. |
| 2011/0030399 | A1 | 2/2011 | Lifson et al. |
| 2011/0041523 | A1 | 2/2011 | Taras et al. |
| 2011/0162395 | A1 | 7/2011 | Chakiachvili et al. |
| 2011/0226785 | A1 | 9/2011 | Sakell |
| 2012/0011866 | A1 | 1/2012 | Scarcella et al. |
| 2012/0085123 | A1 | 4/2012 | Wasnievski da Silva et al. |
| 2012/0198866 | A1 | 8/2012 | Zeidner |
| 2012/0318006 | A1 | 12/2012 | Liu et al. |
| 2012/0318014 | A1 | 12/2012 | Huff et al. |
| 2013/0062356 | A1 | 3/2013 | Deka |
| 2014/0013789 | A1 | 1/2014 | Conrad et al. |
| 2014/0014669 | A1 | 1/2014 | Smith |
| 2014/0191544 | A1 | 7/2014 | Comber, V |
| 2014/0314607 | A1 | 10/2014 | Maeyama et al. |
| 2014/0338390 | A1 | 11/2014 | Pinto et al. |
| 2015/0000318 | A1 | 1/2015 | Pinto et al. |
| 2015/0008242 | A1 | 1/2015 | Kpabar |
| 2015/0021106 | A1 | 1/2015 | LaRosa |
| 2015/0114024 | A1 | 4/2015 | Grepper |
| 2015/0122827 | A1 | 5/2015 | Smith |
| 2015/0241107 | A1 | 8/2015 | Mech |
| 2015/0322698 | A1 | 11/2015 | Seiders |
| 2015/0353263 | A1 | 12/2015 | Seiders et al. |
| 2015/0357755 | A1 | 12/2015 | Hastings et al. |
| 2015/0375918 | A1 | 12/2015 | Holderness et al. |
| 2016/0046418 | A1 | 2/2016 | Crull |
| 2016/0101924 | A1 | 4/2016 | Mitchell et al. |
| 2016/0272047 | A1 | 9/2016 | Gan |
| 2017/0023290 | A1 | 1/2017 | DeMuth et al. |
| 2017/0305638 | A1 | 10/2017 | Sonntag et al. |
| 2017/0313492 | A1 | 11/2017 | Seiders et al. |
| 2018/0141718 | A1 | 5/2018 | Ahlstrom |
| 2018/0273258 | A1* | 9/2018 | Luburic ..... B65D 1/22 |
| 2019/0152677 | A1 | 5/2019 | Hoyt |
| 2019/0161240 | A1 | 5/2019 | Ahlström et al. |

FOREIGN PATENT DOCUMENTS

| | | | |
|---|---|---|---|
| AU | 201712802 | | 5/2017 |
| AU | 201712803 | | 5/2017 |
| AU | 201712785 | | 7/2017 |
| AU | 201712791 | | 11/2017 |
| AU | 201716791 | | 11/2017 |
| CA | 1 249 731 | A1 | 2/1989 |
| CN | 1240728 | A | 1/2000 |
| CN | 1498311 | A | 5/2004 |
| CN | 1629478 | A | 6/2005 |
| CN | 200985884 | Y | 12/2007 |
| CN | 101431913 | A | 5/2009 |
| CN | 102257278 | A | 11/2011 |
| CN | 102261334 | A | 11/2011 |
| CN | 202066275 | U | 12/2011 |
| CN | 103237990 | A | 8/2013 |
| CN | 103471438 | A | 12/2013 |
| CN | 103542661 | A | 1/2014 |
| CN | 103963600 | A | 8/2014 |
| CN | 104583692 | A | 4/2015 |
| CN | 104697279 | A | 6/2015 |
| CN | 106062367 | A | 10/2016 |
| CN | 106068433 | A | 11/2016 |
| CN | 304400680 | S | 12/2017 |
| DE | 30 02 260 | A1 | 7/1981 |
| DE | 41 42 534 | A1 | 7/1992 |
| EM | 004006476-0001 | | 5/2017 |
| EM | 004006476-0002 | | 5/2017 |
| EM | 004006476-0003 | | 5/2017 |
| EM | 004007706-0001 | | 5/2017 |
| EM | 004007706-0002 | | 5/2017 |
| EP | 0 958 952 | A1 | 11/1999 |
| EP | 1 867 504 | A2 | 12/2007 |
| JP | H08-247601 | A | 9/1996 |
| SG | 194217 | A1 | 11/2013 |
| TH | 66500 | | 11/2018 |
| WO | 2006009537 | | 1/2006 |
| WO | 2010/131061 | A1 | 11/2010 |
| WO | 2018095957 | | 5/2018 |

OTHER PUBLICATIONS

European Design Patent Application No. 003847557-0002 entitled "Smart Cooler" filed on Apr. 7, 2017.

European Design Patent Application No. 003847557-0003 entitled "Smart Cooler" filed on Apr. 7, 2017.

European Design Patent Application No. 003847557-0004 entitled "Smart Cooler" filed on Apr. 7, 2017.

European Design Patent Application No. 003847557-0005 entitled "Smart Cooler" filed on Apr. 7, 2017.

Notice of Allowance and Fees Due received in Design U.S. Appl. No. 29/604,424 dated Aug. 10, 2018.

Likchinlow "Igloo Announces Cooler with LiddUp LED Lighting System," Retreived from Internet URL: https://www.ledinside.com/products/2015/1/igloo_announces_cooler_with_liddup_led_lighting_system, published on Jan. 12, 2015, pp. 3.

"Igloo Coolers," retreived from Internet URL: https://web.archive.org/web/20161026143451/https://www.igloocoolers.com/igloo-life/campaigns-party-on, retreived on Jun. 13, 2019, pp. 6.

"Liddup Coolers," retreived from Internet URL: https://web.archive.org/web/20161118120853/http://liddup.com/about.html, retreived on Jun. 13, 2019, pp. 5.

Restriction Requirement received in Design U.S. Appl. No. 29/585,272 dated Oct. 2, 2017.

Restriction Requirement received in Design U.S. Appl. No. 29/585,279 dated Feb. 8, 2019.

Australian Patent Application No. 2017365438 entitled "Cooler" filed on May 6, 2019.

China Patent Application No. 201780072126.1 entitled "Cooler" filed May 22, 2019.

Notice of Allowance and Fees Due received in Design U.S. Appl. No. 29/604,426 dated Aug. 10, 2018.

European Design Patent Application No. 003476415-0001 filed on Nov. 22, 2016.

European Design Patent Application No. 003476415-0002 filed on Nov. 22, 2016.

European Design Patent Application No. 003476415-0003 filed on Nov. 22, 2016.

European Design Patent Application No. 003476415-0004 filed on Nov. 22, 2016.

European Design Patent Application No. 003476415-0005 filed on Nov. 22, 2016.

European Design Patent Application No. 003476415-0006 filed on Nov. 22, 2016.

European Design Patent Application No. 003476415-0007 filed on Nov. 22, 2016.

Transmittal Letter of Related Cases.

Dometic CF Portable Coolers, Dometic Product Catalog 2016.

Dometic RV Refrigeration, Portable Freezers/Refrigerators, Dometic Product Catalog 2015.

Chinese Design Patent Application No. 201730180150 entitled "Latch" filed May 16, 2017.

Chinese Design Patent Application No. 201730180148.2 entitled "Refrigerating Apparatus" filed May 16, 2017.

European Design Patent Application No. 003482694 entitled "Cooler" filed Nov. 25, 2016.

Thailand Design Patent Application No. 1702001859 entitled "Cooler" filed May 22, 2017.

Design U.S. Appl. No. 29/585,279 entitled "Latch" filed Nov. 22, 2016.

Design U.S. Appl. No. 29/604,424 entitled Cooler filed May 17, 2017.

Design U.S. Appl. No. 29/604,426 entitled Cooler filed May 17, 2017.

Design U.S. Appl. No. 29/605,186 entitled Refrigerating Apparatus filed May 24, 2017.

(56) References Cited

OTHER PUBLICATIONS

Design U.S. Appl. No. 29/628,767 entitled Cooler filed Dec. 7, 2017.
European Patent Office, International Search Report and Written Opinion for PCT/EP2017/080018 dated Jan. 25, 2018.
Australian Patent Application No. AU201716789 filed Nov. 8, 2017.
Australian Patent Application No. AU201716791 filed Nov. 8, 2017.
Non-Final Rejection Mailed in U.S. Appl. No. 16/264,057 dated Oct. 3, 2019.
Notice of Allowance received in Design U.S. Appl. No. 29/585,279 dated Sep. 26, 2019.
Design U.S. Appl. No. 29/670,885 entitled "Cooler" filed Nov. 20, 2018.
Design U.S. Appl. No. 29/670,888 entitled "Cooler" filed Nov. 20, 2018.
Design U.S. Appl. No. 29/708,155 entitled "Latch" filed Oct. 3, 2019.
Design U.S. Appl. No. 29/708,156 entitled "Latch" filed Oct. 3, 2019.
U.S. Appl. No. 62/425,288 entitled "Cooler" filed on Nov. 22, 2016.
Notice of Allowance received in Design U.S. Appl. No. 29/670,888 dated Feb. 19, 2020.
Notice of Allowance received in U.S. Appl. No. 29/670,885 dated Feb. 27, 2020.
Rejection Decision Issued in China Patent Application No. 201780072126.1 dated Jun. 3, 2021.
Notice of Allowance Issued in U.S. Appl. No. 29/585,279 dated Jun. 4, 2021.
Final Rejection Mailed in U.S. Appl. No. 16/264,057 dated Jul. 20, 2020.
Office Action received in China Patent Application No. 201780072126.1 dated Oct. 19, 2020.
Notice of Allowance received in Design U.S. Appl. No. 29/585,279 dated Apr. 22, 2020.
Notice of Allowance received in Design U.S. Appl. No. 29/670,885 dated May 26, 2020.
Notice of Allowance received in Design U.S. Appl. No. 29/670,888 dated May 26, 2020.
Notice of Allowance received in Design U.S. Appl. No. 29/585,279 dated Jun. 24, 2020.
Supplemental Notice of Allowance Issued in U.S. Appl. No. 29/585,279 dated Aug. 4, 2021.
Non Final Office Action Issued in U.S. Appl. No. 16/264,057 dated Aug. 30, 2021.
Notice of Allowance Issued in Design U.S. Appl. No. 29/708,155 dated Oct. 27, 2021.
Corrected Notice of Allowance Issued in Design U.S. Appl. No. 29/708,155 dated Nov. 15, 2021.
Office Action received in German Patent Application No. 112017005901.1 dated Oct. 11, 2021.
Examination Report No. 1 for Australia Patent Application No. 2017365438 dated Jul. 28, 2022.
International Search Report and Written Opinion Issued in PCT Application No. PCT/US2020/063545 dated Mar. 10, 2021, 9 Pages.
U.S. Appl. No. 62/967,199 entitled "Cooler Latch" filed on Jan. 29, 2020.
PCT Patent Application No. PCT/US2020/063545 entitled "Cooler Latch" filed on Jul. 12, 2020.
U.S. Appl. No. 17/113,253 entitled "Cooler Latch" filed on Jul. 12, 2020.
Notice of Allowance Issued in U.S. Appl. No. 16/264,057 dated Mar. 30, 2022.
Supplemental Notice of Allowance Issued in U.S. Appl. No. 16/264,057 dated Apr. 14, 2022.
U.S. Appl. No. 17/887,106 titled "Cooler" filed Aug. 12, 2022.

* cited by examiner

COOLER

CLAIM TO PRIORITY

This non-provisional patent application claims priority to and benefit of, under 35 U.S.C. § 119(e), U.S. Provisional Patent Application Ser. No. 62/425,288, filed Nov. 22, 2016 and titled "Cooler", all of which is incorporated by reference herein.

CROSS-REFERENCE TO RELATED APPLICATIONS

Cross-reference is made to U.S. Design patent application Ser. No. 29/585,272, titled "Cooler", and U.S. Design patent application Ser. No. 29/585,279, titled "Latch", both of which were filed on Nov. 22, 2016 and are expressly incorporated by reference herein.

BACKGROUND

Field of the Invention

Present embodiments relate to coolers. More specifically, present embodiments relate to coolers which may have various accessory systems that provide improved functionality of the coolers.

Description of the Related Art

Various coolers are known which are utilized to keep fresh food from spoiling and allow storage for such food for some period of time. Since coolers are widely used, it is always desirable to improve the functionality of such coolers for users.

One problem with existing coolers is providing some connectability to improve functionality in one way or another. For example, it may be desirable to use surfaces of the cooler in order to provide additional seating or it may be desirable to provide accessory mounts to retain other items in or on the cooler in some manner so not to preclude the opening and closing of the cooler. Further, it may be also desirable to improve the manufacturability of such an item while improving the aesthetics for a user.

For these reasons, it would be desirable to provide a cooler with added functionality.

The information included in this Background section of the specification, including any references cited herein and any description or discussion thereof, is included for technical reference purposes only and is not to be regarded subject matter by which the scope of the claims are to be bound.

SUMMARY

A cooler is provided which has various improvements over prior art coolers. The cooler may be a passive cooler or may be actively cooled with a refrigerant system for providing desirable cooling effects. The cooler may include an accessory system, for non-limiting example, with bottle or can holders or a post holder which utilizes the weight of the cooler to support a sunshade. The accessory system may be positioned in various locations of the cooler, one location being in a recess which is utilized to open the cooler lid. The cooler may also comprise a lock assembly which utilizes a tongue disposed in one of the base or the lid and extending through the other of the base or the lid so that the tongue may be locked with, for example, a pad lock or the like. The cooler may also comprise a cushion assembly which may be placed on an upper surface of the lid and may have straps to retain the cushion on the lid. The lid may be formed to accept and retain a cushion so that the cushion does not excessively move from the top surface of the lid.

According to a first embodiment, a cooler with accessory system may comprise a cooler base, at least one cooler lid pivotally mounted relative to the cooler base, a recess disposed in at least one of the cooler base and the at least one cooler lid, an accessory connected to an accessory mount, the accessory mount located on at least one of the cooler base and the cooler lid.

According to some optional embodiments, any of which may be used alone with the first embodiment or with any of the following optional embodiments, the recess may provide a hand lift for opening the at least one lid. The recess may be disposed in at least one of the cooler base and the at least one lid. The cooler may further comprise a slot disposed within the recess. The slot may be disposed along at least two sides of the recess. The accessory mount may be slidably received in the slot when the at least one lid is open. The recess may receive the accessory mount which may be retained in part by the cooler lid. The slot may be defined by an undercut in a wall of the cooler base. The recess may be located in a forward facing surface of the cooler. Alternatively, or additionally, the recess may be formed in a surface other than a forward facing surface. The accessory mount may have one of a receiver or a grasp. The accessory may have the other of a receiver or a grasp. The accessory mount having mounting positions for multiple accessories. The cooler may further comprise a rail for mounting multiple additional accessories. The accessory may be a drink holder, a post holder, or a storage container. The cooler may further comprising a handle mount disposed on the cooler base. The handle mount may have a catch which engages a handle assembly. The handle assembly may receive a handle grip and a cover. The handle grip may be disposed opposite at least one of the first claw and the second claw. The cover may further comprise a tie-down catch.

According to a second embodiment, an accessory mount for a cooler comprises an accessory plate, adapted to be received in a recess disposed in the cooler, the accessory plate comprising at least one of a grasp or a receiver adapted to receive an accessory having the other of a grasp or receiver.

According to some optional embodiments, any of which may be used alone with the first or second embodiment and/or with any of the following optional embodiments, the recess may provide a hand lift for opening the at least one lid, the cooler may comprise a cooler base, at least one cooler lid pivotally mounted relative to the cooler base, a recess disposed in at least one of the cooler base and the at least one cooler lid, wherein the accessory plate is received by the at least one of the cooler base and the cooler lid. The accessory may comprise at least one of a beverage holder, a post holder, a bottle opener or a container. The accessory mount may include the accessory plate and a slot disposed in the cooler.

According to a third embodiment, an accessory mount may comprise an accessory having one of a grasp or a receiver, and, an opposed structure having the other of a grasp or a receiver. The accessory may be connected to the opposed structure. Optionally, the accessory may be one of a beverage holder, a post holder, a bottle opener or a container. The opposed structure is at least one of a plate or a cooler or cabinetry of an appliance system.

According to a fourth embodiment, a cooler may comprise a cooler base, at least one lid pivotally connected to the cooler base, a cushion disposed on an upper surface of the lid, at least one strap extending from the cushion, the strap having a first claw and a second claw engaging one of the at least one lid and the cooler base.

Optionally, according to some embodiments, any of which may be used alone with the firth through fourth embodiments alone and/or with any of the following optional embodiments, the recess may provide a hand lift for opening the at least one lid. the at least one lid may have an indentation on an upper surface to receive the cushion. The lid may have a strap channel. The cooler may further comprise a claw recess having a relief wherein the claw is positioned. The at least one strap may extend from the cushion to each of the first and second claws. The claw may be one of substantially L-shaped, C-shaped or J-shaped. The cooler may further comprise a rail insert disposed along an inner edge of the cooler base. The rail insert may provide a ledge to support a basket or a tray. The cooler may further comprise a handle mount disposed on the cooler base and opposite the first claw and the second claw. The handle mount may have a catch which engages a handle assembly. The handle assembly may receive a handle grip and a cover. The handle grip may be disposed opposite at least one of the first claw and the second claw. The cover may further comprise a tie-down catch. The lid may have a first handhold portion and the base may have a second handhold portion. The first and second handhold portions defining a handhold when the lid is closed. The handhold may having a recess along a lower surface.

According to a fifth embodiment, a cooler may comprise a cooler base, at least one lid pivotally connected to the cooler base, at least one lid grip having a latch depending from the at least one lid grip, the lid grip extending outwardly of a surface of the base, a catch disposed on the surface of the base and beneath the lid grab, the catch capable of being engaged by the latch when the lid is closed. The latch may extend through the lid grip. The fifth embodiment may be used alone or in combination with any of the preceding.

All of the above outlined features are to be understood as exemplary only and many more features and objectives of a cooler may be gleaned from the disclosure herein.

Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the cooler will now be described by way of examples. These embodiments are not to limit the scope of the claims as other embodiments of the cooler will become apparent to one having ordinary skill in the art upon reading the instant description. Non-limiting examples of the present embodiments are shown in figures wherein:

Figure 12:
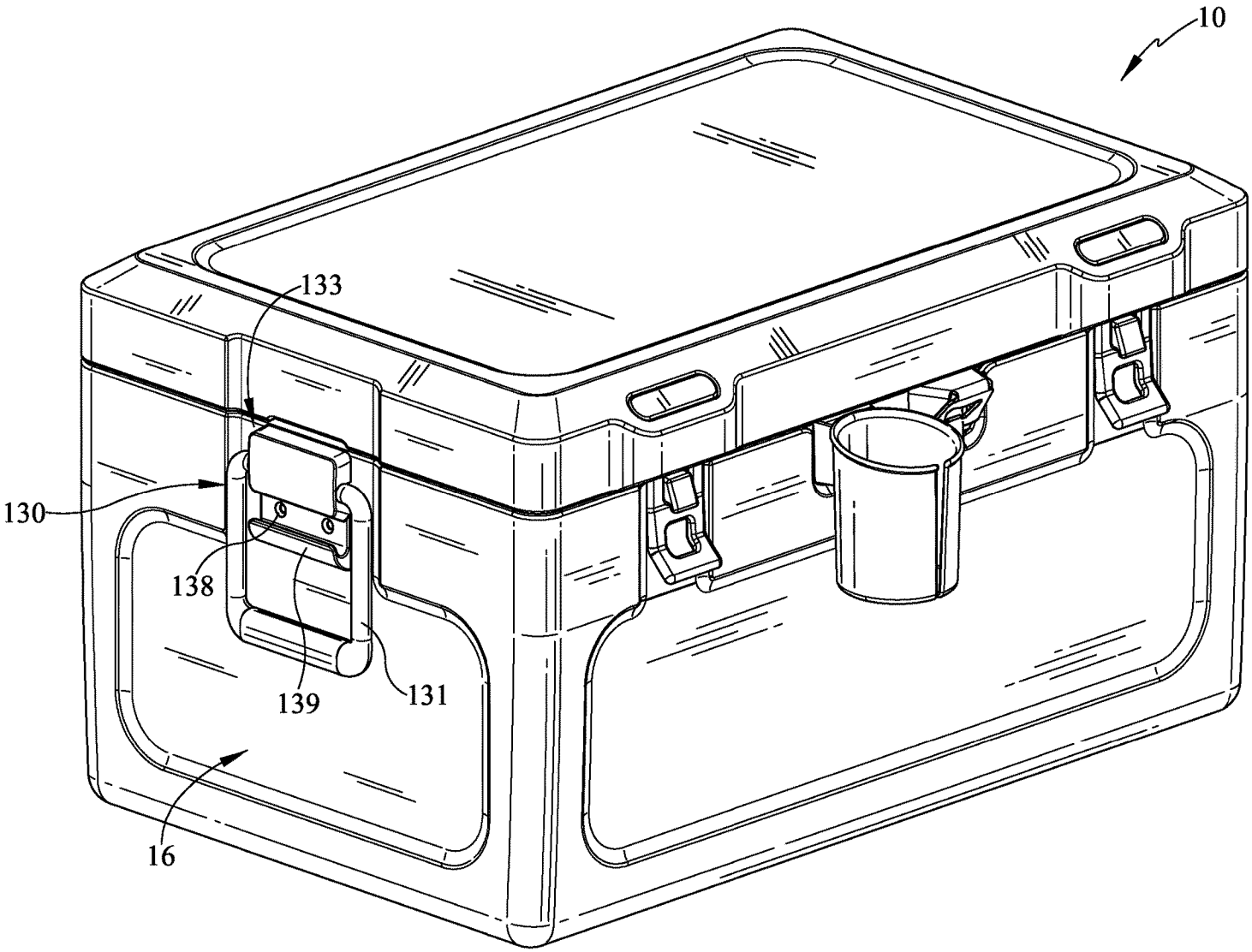
Figure 13:
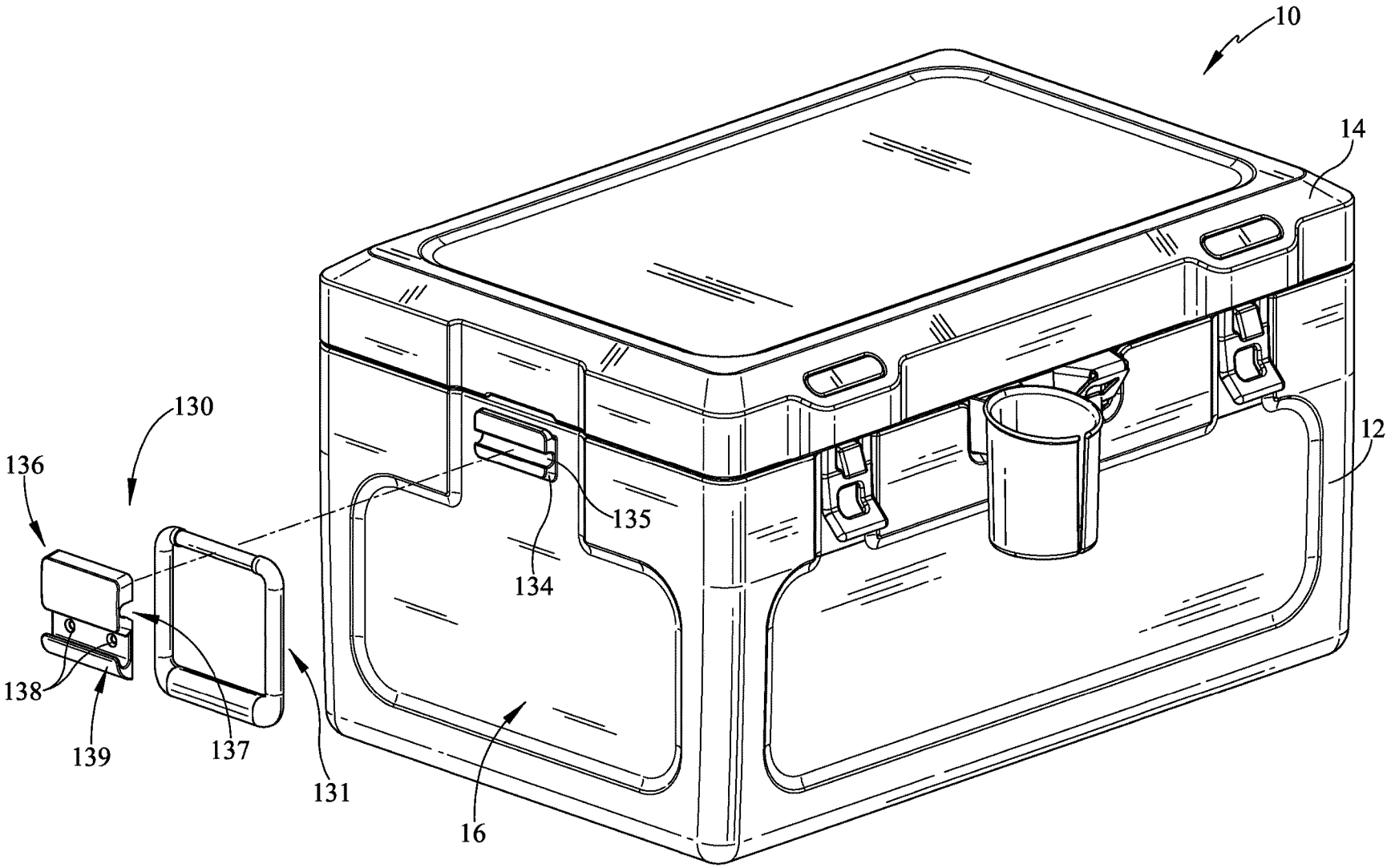

and,

FIG. 12 is a perspective view of an alternate cooler embodiment; and,

FIG. 13 is a perspective view of the cooler of FIG. 12, as well as an exploded handle feature.

DETAILED DESCRIPTION

It is to be understood that the cooler is not limited in its application to the details of construction and the arrangement of components set forth in the following description or illustrated in the drawings. The embodiments are capable of other embodiments and of being practiced or of being carried out in various ways. Different embodiments may be combined to form other different embodiments. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the figures, wherein like numerals indicate like elements throughout several views, including FIGS. 1-13, various embodiments of a cooler are shown which may be passively or actively cooled with refrigeration components, and which may provide for connection of various accessories to improve functionality of the cooler. An accessory system is provided which allows for mounting of accessories, such as holders which also improves functionality of the cooler. Still further, the cushion retaining system is provided and wherein the lid is also provided with structure to aid in retention of the cushion on the cooler lid.

Figure 1:
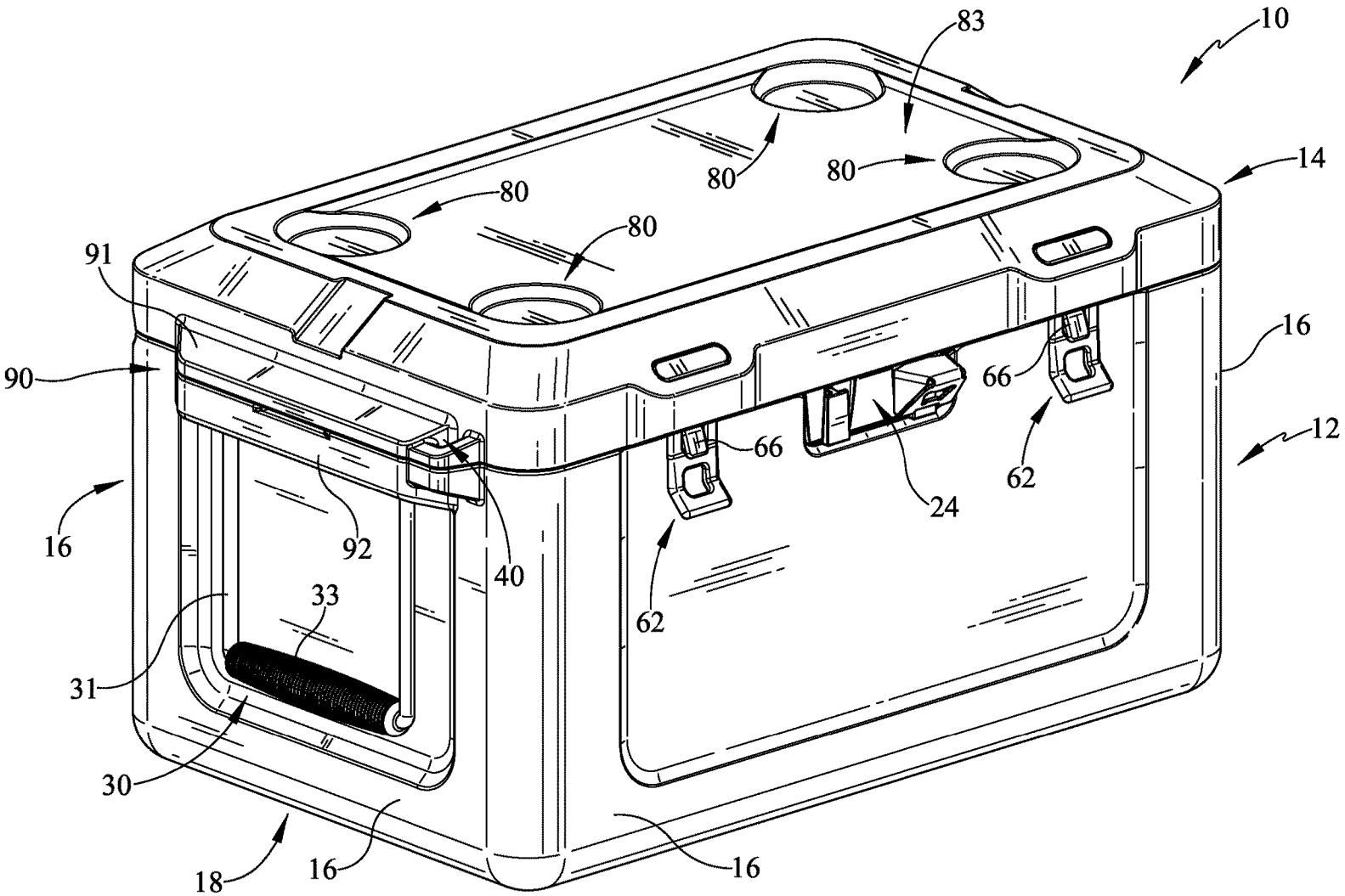
FIG. 1 is a perspective view of a non-limiting example of a cooler.

Referring now to FIG. 1, a perspective view of a non-limiting cooler 10 is depicted. The cooler 10 includes a base 12 and at least one lid 14, which is pivotally connected to the base 12. The base 12 and the lid 14 may be formed of various plastic types, for example polyethylene based, such as HDPE (high-density polyethylene), and may be double-walled and may also have insulation therebetween to improve the cooling efficiency or to inhibit heat transfer across the cooler walls 16 or the lid 14. In some embodiments, the cooler may be roto-molded to provide a cooler of continuous thickness and minimal imperfections. The rotomold may include dense insulation as well as one or more seals to keep cold inside and heat outside. The base 12 may have four sides or walls 16 and a bottom 18 which define an open volume within the base 12. The open volume may be entirely open or may be partitioned. The sides 16 may be formed as one integral part rather than separates walls and bottom. Each of the sides 16 is defined by the walls and may or may not include fluid conduit for refrigeration, for example if the cooler is an active cooler including a refrigerant compression system. The cooler 10 is shown to have a rectangular interior opening forming food basin 20 (FIG. 4) defined by the sides 16 and the bottom 18. However, other shapes may be provided by varying the shape of the sides 16 and the connection angles of the walls therebetween. Likewise, the shape may also be varied by varying the length of the walls. In the present embodiment, the cooler 10 has two long walls (front and rear), which are parallel, and two short walls (sides), which are parallel, to define the rectangular shape. However, the sides 16 may have walls of the same length or varying length and same or differing angles therebetween. Within this space or food basin 20 (FIG. 3), food or drinks may be stored and retained in a cooled or cooler environment than ambient temperature. This reduces food spoilage of fresh foods and may also keep beverages cool, all of which may be stored therein.

The lid 14 may be pivotally connected in a variety of manners. In some embodiments, one or more passages may be formed in each of the lid or base 14, 12 or when placed together, the one or more passages may be defined. The lid and base may be formed by one or more rod, tubes or fasteners, such as screws. Other embodiments of hinges may include living hinges connected to or formed on either or both of the lid and base 14, 12. Still further, the multi-piece hinges may be used to provide a pivoting function of the lid 14 relative to the base 12.

While a single lid 14 is shown in the depicted embodiment, other embodiments may be provided and within the scope of the instant claims which provide more than one lid to cover the opening defined by the base 12. For example, the lid 14 may be two lids which are of equivalent or differing size. Further, in larger cooler sizes, three or more lids may cover the base 12. Likewise, the base 12, and more specifically the food basin 20 (FIG. 3), may be partitioned to provide multiple storage areas wherein the wet products may be separated, for example, from dry goods. The partitions may or may not be sized to match the two or more lid sizes.

The cooler 10 may be an actively cooled system or a passively cooled system. An actively cooled system may be one which includes a plurality of refrigeration components. An actively cooled system may include a compressor, a condenser, an evaporator and metering device through which refrigerant passes, or alternatively may include a thermoelectric device for cooling. Other types of cooling technology may be utilized. In further alternatives, a passively cooled system is one which may utilize ice to keep the contents stored in the food basin 20 cool.

The front surface of the cooler 10 is shown with a recess 24 defined in at least one of the lid 14 and in the base 12. The recess 24 provides a space where a user may place their hand to lift the lid 14 to open the cooler 10, although this functionality is not a necessary function. For example, as depicted, the recess 24 is formed in the base 12 so that a lip is formed over the base 12 by the lid 14, which aids in lifting the lid 14. Further, while the recess 24 is shown on the front surface of the cooler 10, the recess 24 may be moved to other surfaces, or alternatively additional recesses may be located at other locations of the cooler 10. The recess 24 may also be located fully in the base 12 or partially in the base 12 and the lid 14, or alternately fully in the lid 14. The recess 24 also provides a location for positioning of the accessory mount 26 (FIG. 2), as described further herein.

The cooler 10 also includes at least one handle 30 mounted to an at least one side 16 of the cooler 10. In the instant embodiment, the cooler 10 includes handles 30 at both lateral ends. Additionally, the cooler 10 may include a lock assembly 40 positioned to lock the lid 14 closed relative to the base 12, or allow access therein.

With reference to the handles 30, each handle may be formed of a woven or non-woven loop 31 upon which a handgrip 33 may be disposed. The loop 31 may be formed, for example, of a hard plastic material which can support a load for carrying the cooler 10. In other embodiments, the loop 31 may be formed of rope or rope-like materials, natural, synthetic or combinations. The handgrip 33 may provide a more ergonomic structure for gripping the loop 31. In this embodiment, the handle 30 is depending from a handhold 90. In other embodiments, described and shown further herein, the handle 30 may be connected to other structures formed on the base 12.

The cooler 10 may also comprise a latch system which includes locking latches 62 extending through the lid 14 and engages catches 66 on the base 12, or vice versa.

The cooler 10 also may comprise at least one handhold 90 at lateral ends of the cooler 10 in order to provide an ergonomic grip for a user's hand, for example to aid in carrying. The handhold 90 may be formed of portions 91, 92 of the lid 14 and the base 12, respectively so that the handhold 90 may improve ergonomics. The handhold 90 may be recessed along a lower surface so that fingers may be curled underneath to aid in handling. Also, since the handhold 90 is formed on both of the lid 14 and base 12, which are aligned, the handhold 90 provides a thick area to aid in ergonomics. For example, with fingers curled underneath, the user's thumb may be placed over the upper surface of the handhold 90. In some embodiments, the upper portion 91 may be formed on the lid 14 and the lower portion 92 may be formed on the base 12, for example.

Figure 2:
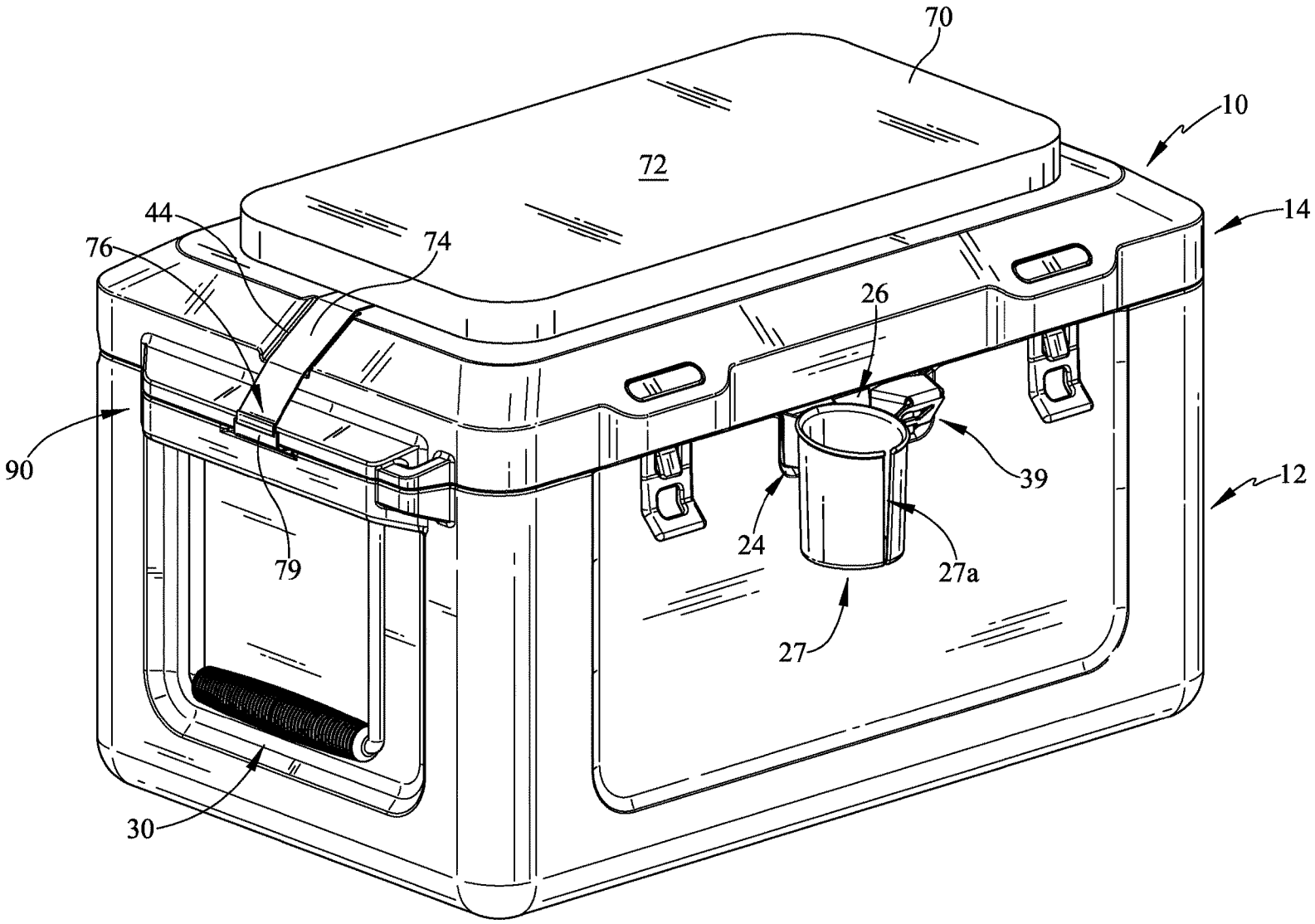
FIG. 2 is a perspective view of the cooler of FIG. 1 with a cushion and accessories mounted on the lid, which is in a closed position.
Figure 3:
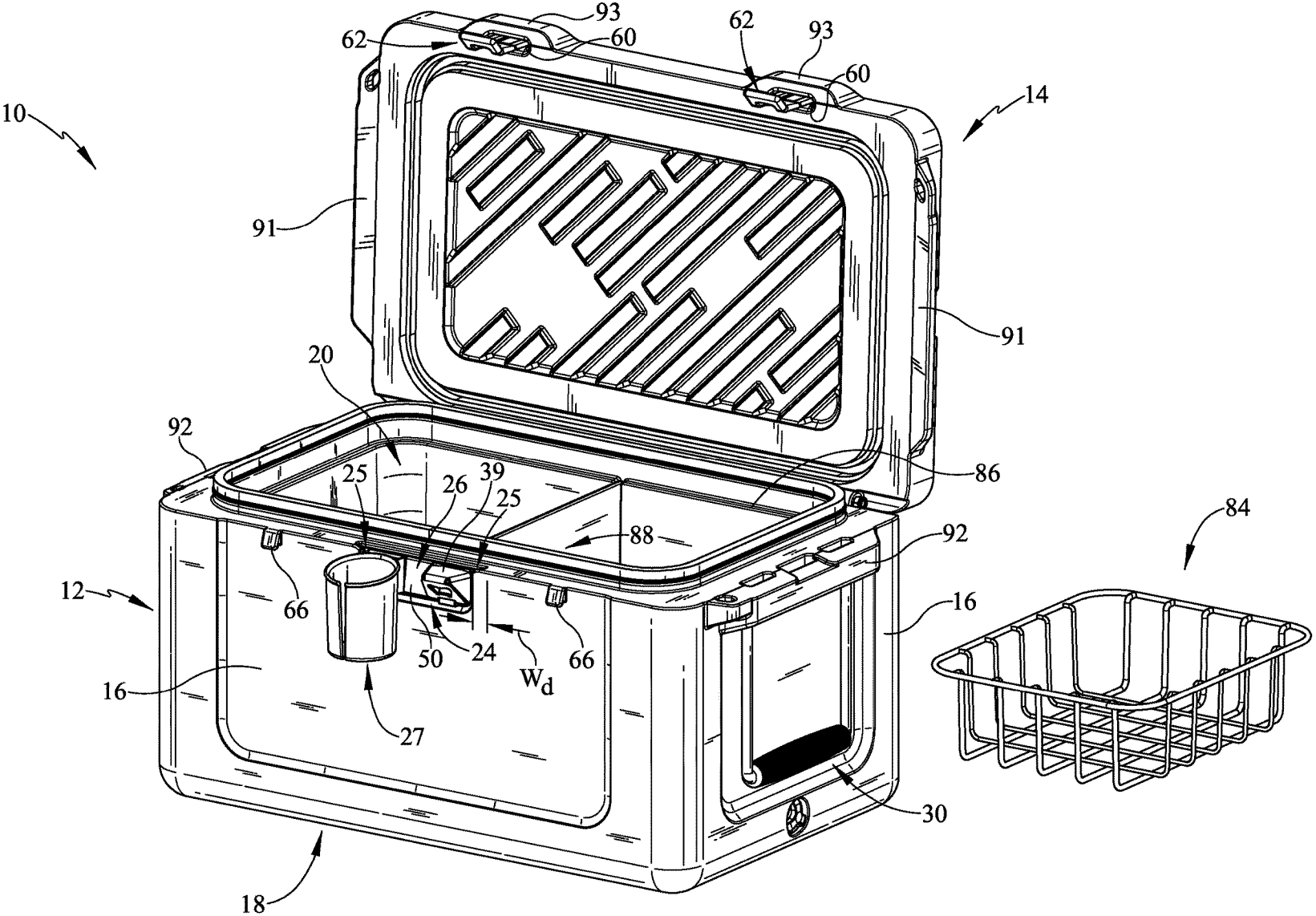
FIG. 3 is a perspective view of the cooler of FIG. 1 with the lid opened and including accessories in a usable position.

Referring now to FIG. 2, a perspective view of the cooler 10 is shown with a cushion 70 and additional accessories 27, 39. The cooler 10 includes the recess 24 which may be defined, at least in part, by either or both of the base 12 and the lid 14. The recess 24 provides a location where a user can touch the lid 14 and lift the lid 14 from the base 12. Disposed within the base 12 and within the recess 24 is the accessory mount 26 including accessories 27, 39. The accessory mount 26 may be formed in part by a plate 50 (FIG. 3). The term "plate" is used but the structure need not be planar, partially or entirely, and should not be limited in such manner. The plate 50 may have one of a male or female grasp or receiver and the accessories 27, 39 may have the other of the male or female grasp or receiver. Using the receivers and grasps, the accessories 27, 39 may be connected in a removable or disconnectable fashion. In some other embodiments, the accessories 27, 39 may be connected in a permanent or non-disconnectable manner. This may be desirable for accessories carrying higher weight or higher loads, for example. In still other embodiments, the accessories 27, 39 may be directly connected to the cooler, for example, by eliminating the plate 50 and forming the grasps or receivers directing on the cooler 10. Or in other embodiments, the plate may be connected to other structures such as an appliance system, including cabinetry or a slide out assembly for outdoor cooking.

The plate 50 may be of a width which is greater than the width of the opening defined by the recess 24. Accordingly, the plate 50 may be sized to extend into an opening, such as a slot or other partially hidden recess which is formed in one of the lid 14 and/or the base 12. In the instant embodiment, the plate 50 is positioned in a slot which is formed at lateral edges of the recess 24 of the base 12 and optionally may be formed along the lower edge of the recess 24. More specifically, at least one dimension of the plate 50 is oversized relative to recess 24 so that the plate 50 is retained behind the edges of the recess 24. For example, the width may be wider than the recess so that the plate 50 cannot be pulled forward, out of the recess 24. Alternatively, or additionally, the plate 50 may be taller than the recess 24, so that the plate 50 is engaged by a slot in the lid 14.

On the upper surface of the lid 14 is a cushion 70. By comparison with, and additional reference to FIG. 1, the top of the lid 14 may have a plurality of drink holders 80 or may be blank as shown in FIG. 12, both of which may be covered by the cushion 70 as shown in FIG. 2. The cushion 70 may be covered in various desirable aesthetic coverings 72 and may include a plastic, rubber, open cell foams or closed cell foams, or other type cushioning material (not shown) within the covering 72. It may be desirable that the cushion 70 is formed or treated with a weather resistant coating such that rain or other contaminants due not damage the cushion 70. The cushion 70 further comprises at least one strap 74, including a first end 76 and a second end 78 (FIG. 9) which retain the cushion 70 on the lid 14. The strap end 76 may also comprise a claw 79 which is formed to retain the strap 74 to the lid 14 so that the cushion 70 does not slip from the lid 14. The lid 14 may comprise strap channels 44 wherein the at least one cushion strap 74 may be located. Likewise, the handhold 90 may also provide a clearance wherein the claw 79 is located.

Referring now to FIG. 3, a perspective view of cooler 10 is depicted with the lid 14 in an open position to depict the accessory mount 26. The accessory mount 26 may be defined in part by a slot 25 formed in at least one of the base 12 and lid 14, as well as the accessory mounting plate 50, which may have indentations or embossments. In this view, the cooler 10 is shown with the lid 14 in an open position and the base 12 primarily depicted. The base 12 includes the recess 24 which is utilized in part as a gripping area to open the lid 14. The recess 24 further comprises a slot 25. The slot 25 is formed in the wall 16 that defines the recess 24 of the base 12. In some embodiments, the slot 25 may be formed as an undercut in the opening or recess 24 so that the slot 25 is wider than the recess 24 when viewed from the front of the cooler 10. This is indicated by a width differential $W_d$. In this way, the slot 25 is generally hidden from view and easily seen by a user. While the slot 25 may be formed in the walls or sides 16 of the base 12, in some embodiments, the slot 25 may also be formed in the lid 14. In this way, the plate 50 may extend into the lid 14. The slot 25 may not be required however, where the grasps or receivers are formed directly on the cooler 10, and thus maybe considered an optional feature.

Also shown on the lid 14 are the handhold portions 91, 92. The instant embodiment provides these along the lateral ends of the structure. These are formed of similar length to the handhold portions 92. Also shown along a forward edge of the lid 14 are lid grips 93 which are formed to include apertures 60. The lid grips 93 are also formed to provide a location to grasp the lid 14 and lift it. Further, the lids grips 93 provide a location through which latches 62 may extend. More specifically, the lid grips 93 provide a location at which there is provided some offset relative to a front surface of the base 12, so that the latches 62 can engage catches 66 on the front surface of the cooler 10.

Also shown in this embodiment is an exploded basket 84. The basket may be wire formed or may be solid and may be placed in the cooler 10 in such a manner as to be separated from food or drink below. This may be desirable for example, when it is desirable to limit a food product from becoming wet, which may occur when ice melts, for example. Other reasons may exist as well for the use of such basket 84.

The basket 84 may be supported along a ledge 86 of the cooler 10 along an inner surface. The ledge 86 may be formed by an insert or in an alternative may be formed integrally with the interior surface of the cooler, for example during the molding process. Still further, the cooler 10 may also have a partition 88 is also an insert in some embodiments or in other, or in addition, may be molded in position. The partition 88 may be removable, when formed as an insert, from the interior to open up the entire volume of the cooler 10. Further, the upper edge of the partition 88 may also define a support for the basket 84 if the two items are sized in a corresponding matter. However, when removed, the basket 84 may also be supported by the ledge 86 along at least two edges of the basket 84. Further, for improve utility, when the partition 88 is not utilized, the basket 84 may be slidably moved along the ledge 86 to improve access to food and drinks below. Still further, while a single basket 84 is shown, two or more baskets may be inserted in the cooler to provide additional separate storage from food products below.

Figure 4:
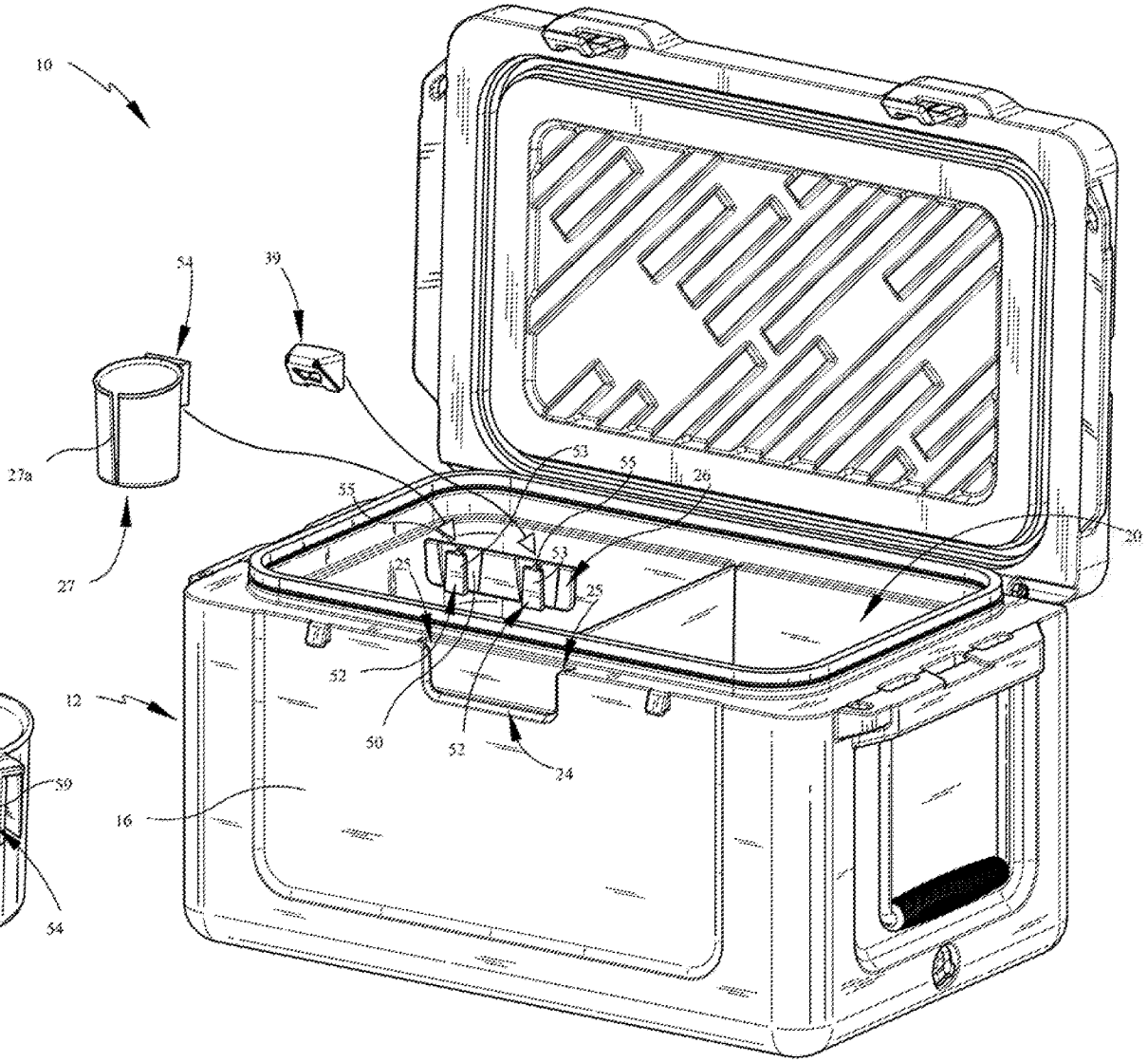
FIG. 4 is a perspective view of cooler with the accessory mount partially exploded.
Figure 4A:
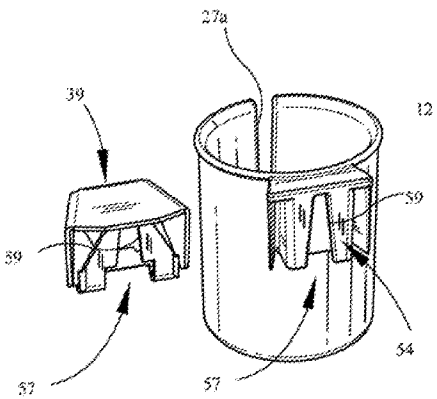
FIG. 4A is a rear perspective view of accessories having engagement features.

Referring now to FIGS. 4 and 4A, a perspective view of the cooler 10 is shown with the accessory plate 50 and accessories 27, 39 exploded from the cooler base 12. FIG. 4A depicts a rear perspective view of an accessory which connects to the accessory plate 50. The accessory plate 50 is formed also wider than the recess 24 so that the plate 50 fits within the slot 25 and is retained by the side or wall 16 in which the recess 24 is formed. The plate 50 may have a height which is at an equivalent height or below the top surface of the base 12 or may be taller so that when the lid 14 is closed, the plate 50 extends at least partially into the lid 14 where a slot may also be formed.

The plate 50 may be generally rectangular as shown corresponding to the recess 24 shape or may be formed of other shapes and may include one of a grasp 52 and a receiver 54. The grasp 52 is formed as a male part to have a head 53 and a neck 55. The head 53 has a width that this greater than the neck 55 so that the grasp 52 is retained in the receiver 54.

Likewise, the receiver 54 is a generally female part which receives the male grasp 52. The receiver 54 has a lateral slot 57 which is wider than a channel 59. The slot 57 receives the head 53 and the channel 59 receives the neck 55. The grasp 52 may be slidably disposed in the receiver 54 and once therein the head 53 engagement within the slot 57 inhibits removal in a direction perpendicular to the longitudinal direction of the slot 57. Other embodiments including shapes and structures may be utilized to retain the grasps 52 and receivers 54 together. The exemplary receivers 54 may also have a closed bottom so that the grasps 52 cannot fall or slide through the receiver 54. Or alternatively, the grasps 52 and receivers 54 may be tapered or otherwise provide for some interference when the grasps 52 are fully inserted in the receiver 54. For example, as shown in the instant embodiment, the heads 53 are slightly more narrow at the top and wider at the bottom in a lateral direction, so that the grasp 52 and receiver 54 frictionally engage as the accessories 27, 39 move on to the plate 50. The taper may also change in other directions, for example non-limiting example, front to back direction (thickness) so that the accessory 27, 39 is retained on the plate 50. Other types of frictional or interference engagements may be utilized, as well as other fastening structures.

In the instant Figures, attached to each of the receivers 54 is one of the accessories 27, 39 and the grasps 52 may be formed on the plate 50. However an opposite configuration is also possible wherein the receivers 54 may be formed on the plate 50 and grasps 52 formed on the accessories 27, 39. In some embodiments, the accessories 27, 39 are disconnectable but in other embodiments, the connection may be a fixed connection, for example to provide an improved support for a fishing rod or an umbrella post for shade wherein added strength may be necessary or desirable. The fixed connection may be locking or the parts may be formed integrally with the plate 50, for example. Still further, while the plate 50 is shown exploded from the recess 24, the plate may be permanently affixed, such as by an adhesive, or may be formed integrally with the cooler 10. Still further, as previously indicated, the plate 50 may be positioned in the lid 14 and engage the base 12 when the lid 14 closes.

The accessory 27 is shown as a bottle, cup or can holder. This provides a place to retain a bottle, cup or can of a preferred drinking beverage so that, for example, if the beverage can, cup or bottle, and beverage therein, is being enjoyed at a beach, it is retained above the sand and the sand does not coat or cake the bottle, cup or can. Alternatively, if cooler 10 is utilized at a picnic area and there are insects in the grass or on the ground, the beverage container is again retained above the ground reducing the insects from entering the beverage container. The accessory 27 also includes a relief 27*a* which will expand slightly if a can or bottle is slightly larger than the opening at the top of the accessory 27. Still further, the relief 27*a* may allow for resilient spring effect as well as allow for drainage of the condensation, spilled or other fluids.

Similarly, an accessory 39 is provided which also connects to the cooler 10. The accessory 39 may be a bottle opener, which is used to remove bottle caps from bottles. The accessory 39 may be disconnectable from plate 50 or may be formed integrally with plate 50.

Figure 5:
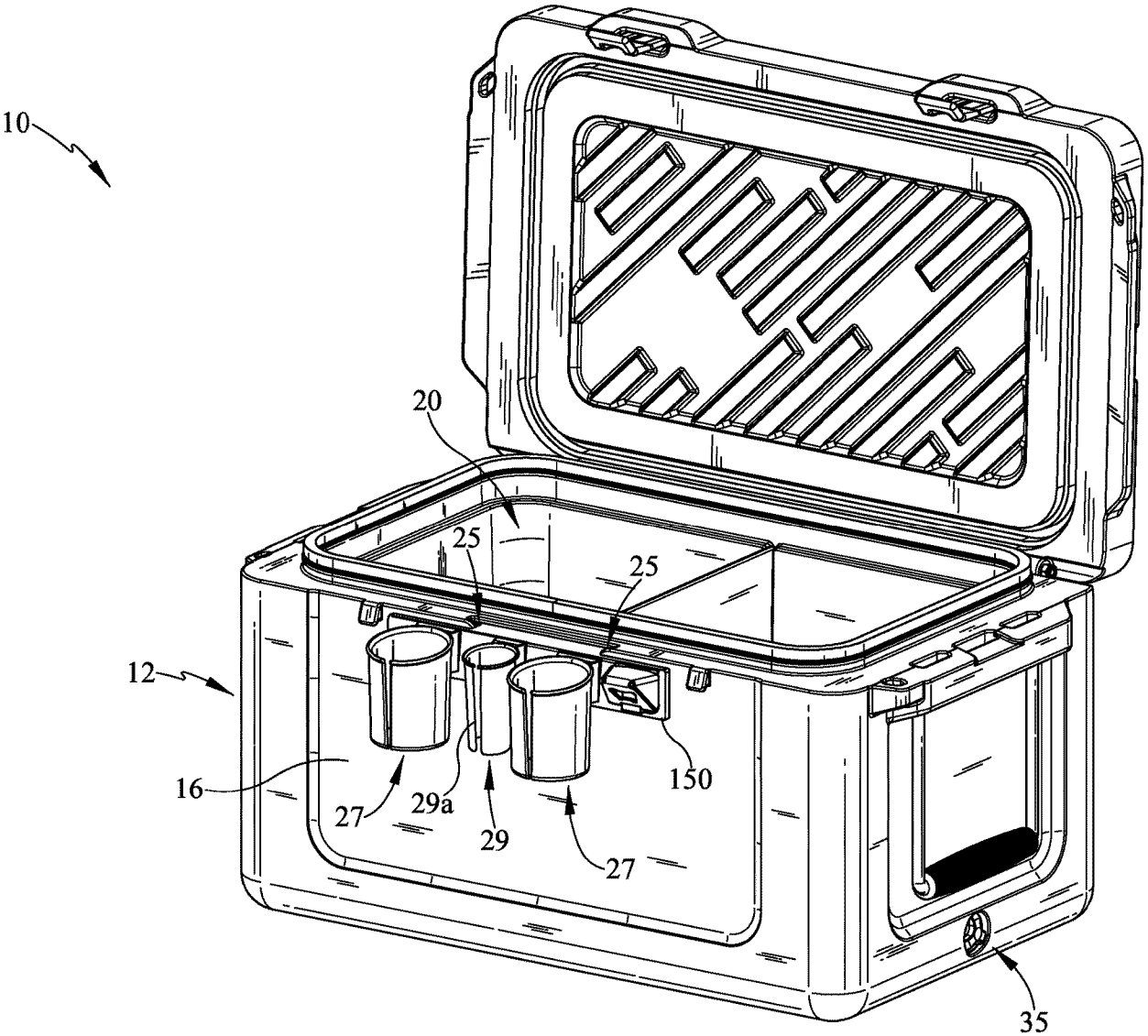
FIG. 5 is a perspective view of the cooler with the lid opened and the a second accessory rail having additional accessory positions.
Figure 11:
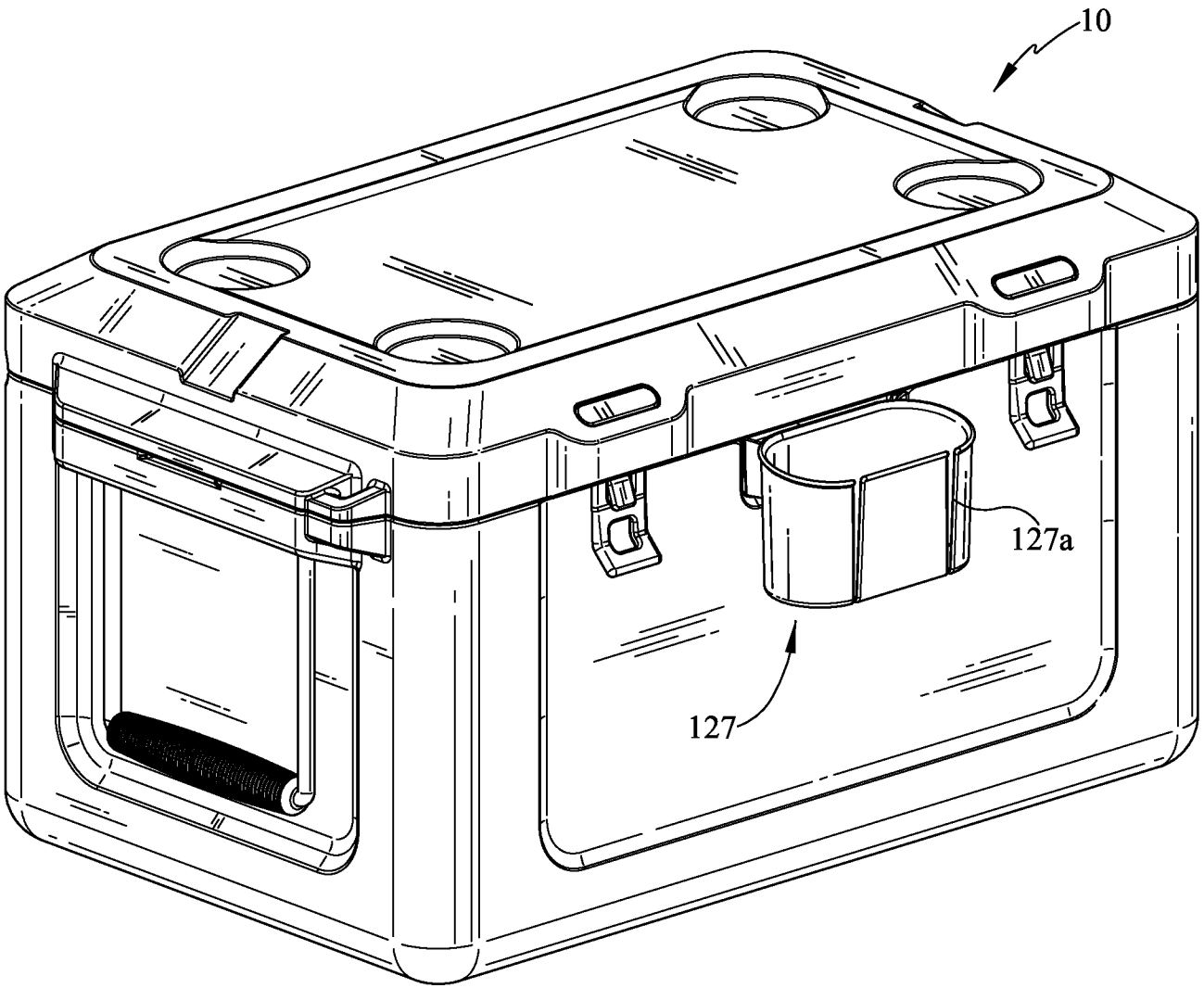
FIG. 11 is a perspective view of a cooler with a further alternate container accessory.

Other accessories may also be utilized, in addition to the can/bottle holder 27 and the bottle opener 39, an umbrella or other post holder 29, for example as shown in FIG. 5 or a general container 127 (FIG. 11). The accessory 39 is a bottle opener which may be utilized to pry a bottle top off of a bottle, for example off of a beer bottle. The accessory 29 (FIG. 5) functions to receive a post of a sun shade, such as an umbrella type sun shade, or alternatively, to retain a fishing pole. The accessory 29 likewise includes a relief 29*a* which allows the accessory 29 to slightly expand when the post is positioned into the accessory 29. The relief 29*a* also both allow for drainage. The accessory 29 may or may not have a bottom to allow passage through of the fishing pole or sun shade post. For example, other accessories which may be utilized include, but are not limited to, fishing rod holder, container for phone, wallet, coins or the like. Various of these embodiments are considered storage devices because they retain or store some or all of another part.

Referring now to FIG. 5, an alternate embodiment is depicted. In this embodiment, a second accessory rail 150 is connected to plate 50. The second rail 150 may have one of a grasp, receiver 52, 54 on a rear surface to engage the other grasp or receiver of the plate 50. Further, the rail 150 may have two grasps or receivers to connect to all of the grasps or receivers on the first plate 50. With the plate 50 in position in the recess 24, the second accessory rail 150 is retained in position. The second accessory rail 150 provides mounting locations for additional accessories as compared to plate 50. In the instant embodiment, there are four receivers to retain additional accessories thereon. The second rail 150 is also spaced from and connected to plate 50 so that it clears the front surface of the cooler 10 when connected to plate 50. The rail 150 may also engage the front surface of cooler 10 so that the rail 150 is supported by the front surface of the cooler 10.

Also shown in FIG. 5, is a plug 35 which stops a drain located in at least one wall 16. The drain plug 35 allows for melted ice and other fluids to be drained or removed from the cooler 10 without emptying any remaining contents therein. The drain plug 35 may be a threaded, twist lock or friction/interference fit, for non-limiting example, or other type of plugging structure.

Figure 6:
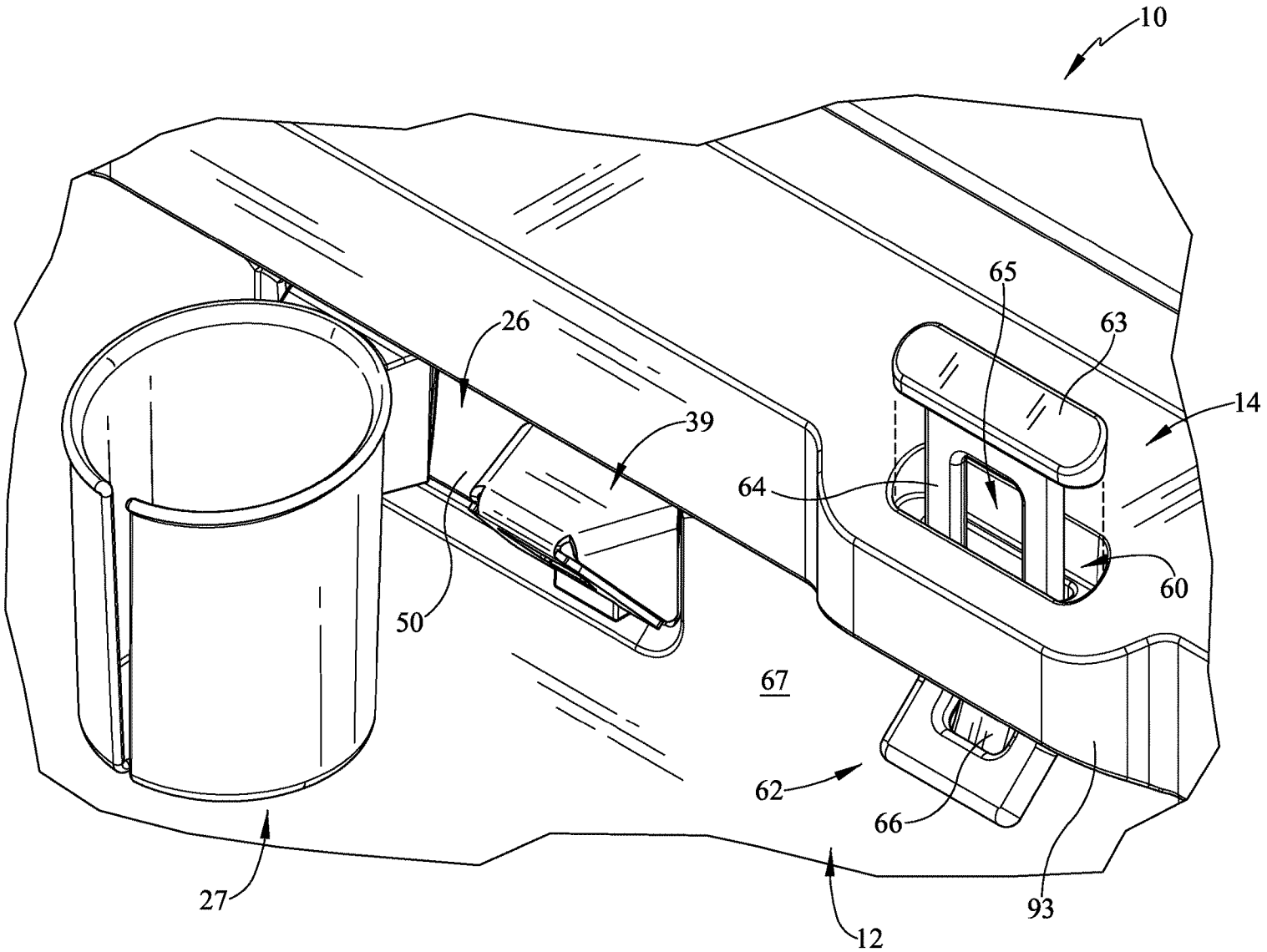
FIG. 6 is a perspective view of a portion of the cooler including a lid grip with an aperture and a latch partially exploded therefrom.

Referring now to FIG. 6, a perspective view of the cooler 10 is shown with the locking latch 62 exploded from the lid 14. A second improvement of the instant cooler 10 provides for the locking latches 62 that extend through the lid 14. As described previously, the lid 14 includes a lid grip 93 which extends forward of a front surface of the base 12. Additionally or alternatively, the base 12 may include a recess 67 in a surface to improve the offset in the forward rearward direction of the cooler 10, of the lid grip 93. The lid grip 93 provide a convenient place to lift the lid 14, as well as a position for the latch 62. The lid grip 93 includes latch apertures 60 which extend through the lid grip 93, for example vertically, and receives the locking latch 62. Each locking latch 62 includes a base 63 and a latch strap 64, which cantilevers and/or depends from the base 63. The latch strap 64 may be linear or may be formed of two or more segments which in some embodiments may be angled relative to one another. The present embodiment provides a first segment which depends vertically and a second which angles outwardly away from the base 12. This makes grasping the latch 62 somewhat easier. Also, the angled segment also aids in passing the latch 62 over the catch 66.

The latch strap 64 may also have at least one catch aperture 65 which engages the catch 66. The catch aperture 65 receives the catch 66 therein and once positioned over the catch 66, the lid 14 is locked in a downward position so the lid 14 cannot be lifted. The latch strap 64 may be formed of a material capable of deforming elastically in order to clear the catch 66 on the base 12 and allow the aperture 65 to receive the catch 66. The elasticity or resilience also provides a force against the catch 66 which pulls the lid 14 closed tightly. The latch straps 64 may be formed of various firm but flexible materials including, but not limited to, plastics and/or rubbers.

The latch aperture 60 extends through lid grip 93 of the cooler 10 which is also disposed above a catch 66 formed on the base 12. The locking latch 62 extends downwardly through the lid 14 to engage the catch 66 formed on the base 12 and to retain the lid 14 in the closed position. The cooler 10 may comprise one or more of these locking latches 62. These may be positioned on any of the sides of the cooler, including but not limited to the front surfaces as shown, and may be disposed on a side opposite the hinge connection between the lid 14 and the base 12. A front surface recess 67 on the base 12 may also be used to provide further clearance so that the latch strap 64 may extend and engage the catch 66.

The catches 66 may be of various shapes when viewed in a side view. For example, the front surface may be angled so as to aid the strap 64 in passing over or when the lid 14 is closing. Alternatively, the catch 66 may be square in shape and may have rounded upper corners to aid the latch strap 64 in passing over the catch 66. Additionally, the catches 66 may have an overhang portion to aid in retaining the latch strap 64 in the locked position.

The latch aperture 60 is sized to receive the latch base 63 and may be of varying shapes which match, correspond or otherwise allow for seating or receipt of the latch base 63 therein. The latch base 63 may have various shapes and may be non-tapered or tapered, for example from front to rear and/or top to bottom, and accordingly, the aperture 60 may have a floor which corresponds in shape and mating. It may also be desirable to use a material to increase frictional engagement or wedging of the latch base 63 in the aperture 60. Further, the latch base 63 may be formed of various shapes which correspond in shape to the aperture 60 or vice-versa. The view depicts an elongated body with curved ends for both the aperture 60 and the latch base 63. However, this is one example and other shapes may be utilized. Still further, the materials of the latch 62 may be formed of a slip resistant or relatively higher friction material so that the latch 62 is resistive to sliding out of the aperture 60. Additionally, adhesives or other glue-like materials may be utilized. While one assembly of a latch 62 and aperture 60 is shown in this view, one skilled in the art should understand, that more than one assembly of these parts may be used about the cooler 10 as needed to retain the cooler in a closed position.

Figure 7:
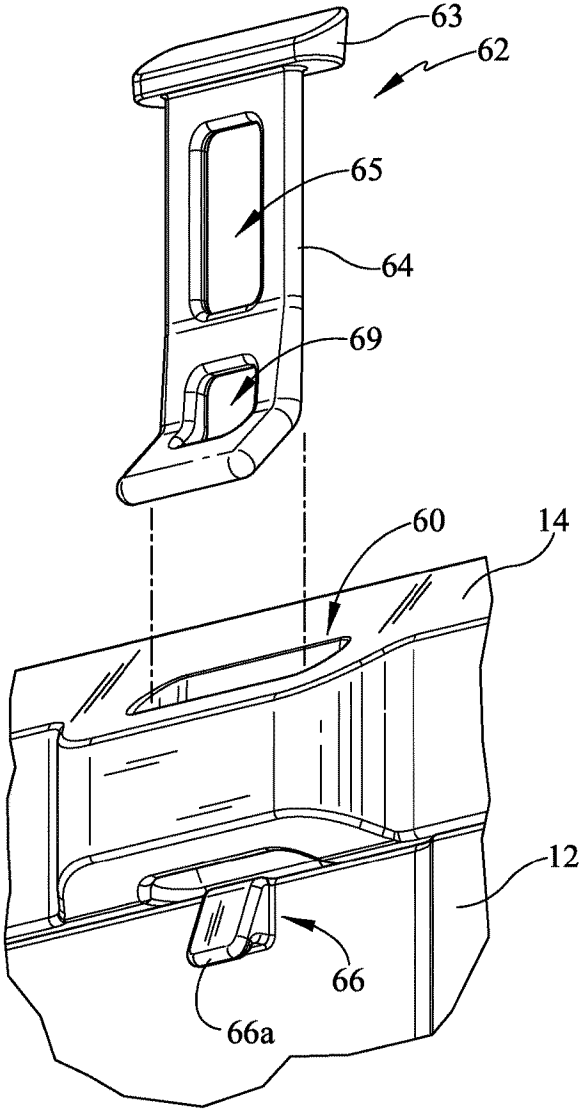
FIG. 7 is an exploded perspective view of a latch and a latch aperture in a lid grip.

Referring now to FIG. 7, a lower perspective view of the latch 62 and latch aperture 60 is shown. The latch 62 is shown from below so that the bottom of the base 63 is also visible. In this embodiment, the latch strap 64 is shown as elongate with a strap relief 69 that allows for, along with the material type, stretching of the latch strap 64. Further, the aperture 65 may also improve flexibility of the latch strap 64 in the forward-rearward direction.

Also, the latch strap 64 includes the catch aperture 65. Beneath the locking latch 62 is the catch 66. As depicted the catch 66 is vertically aligned with the latch aperture 65 so that when the locking latch 62 is inserted in the lid 14 and the lid is closed, the latch strap 64 may be stretched over the catch 66. Further, the catch 66 may include an overhang, lip or protuberance 66*a* which also requires stretching of the latch strap 64 to either place over or remove from the catch 66.

Further, as described, the lower end of the latch strap 64 may be angled or curved so that the lower segment is more easily grasped. Once grasped, the latch strap 64 may be pulled down and away from the cooler 10 to release the latch 62 from the catch 66 or alternatively, down and over the catch 66 to engage the latch 62 with the catch 66.

Figure 8:
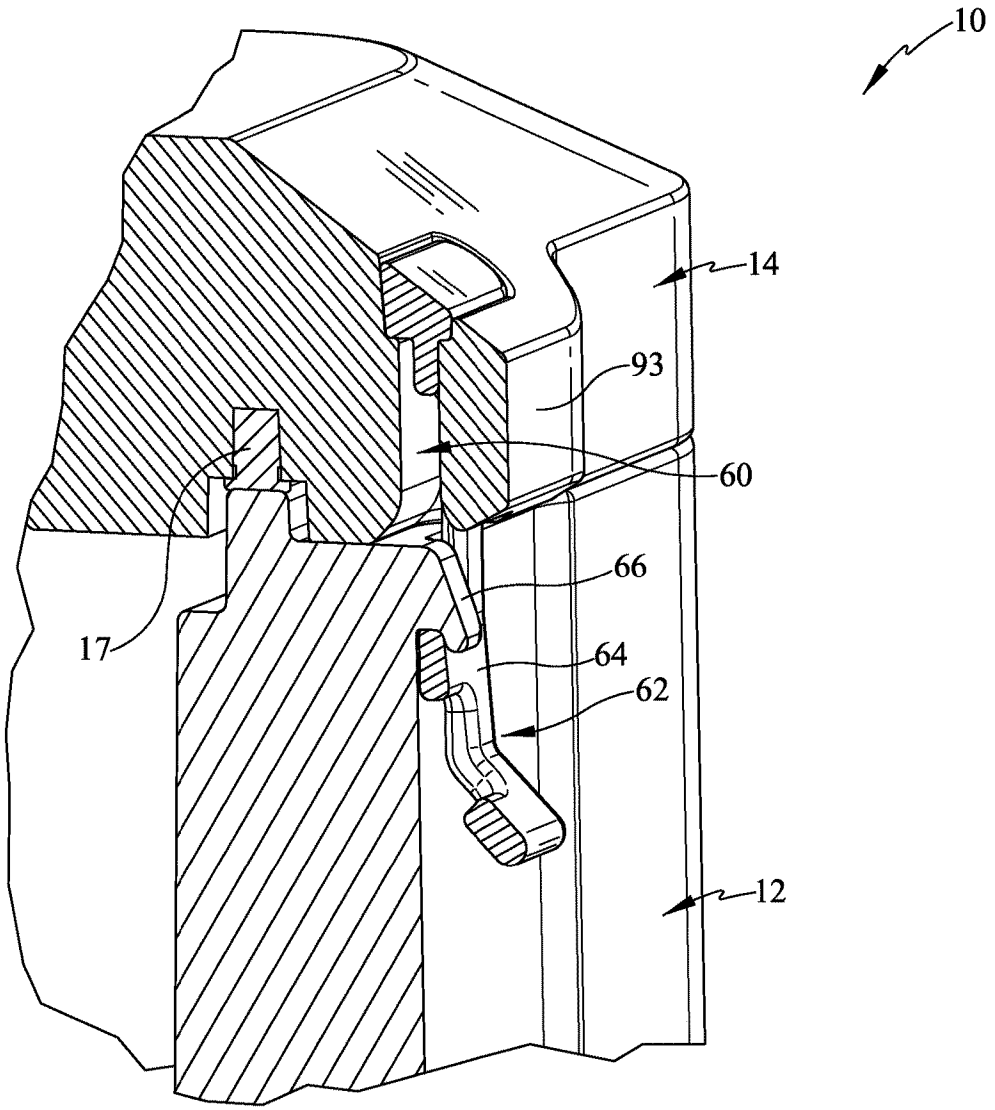
FIG. 8 is a section view of a latch and latch aperture as well as a catch that engages the latch.

With reference now to FIG. 8, a section view of the cooler 10 is shown. The section is taken through the lid 14, base 12 and the lid grip 93. This allows viewing of the locking latch 62 extending through the lid 14 and engaging the catch 66. Once the latch strap 64 is drawn around the catch 66, a seal 17 on one of the lid 14 and the base 12 may be compressed or otherwise maintain sealed engagement between the lid 14 and base 12. Likewise, in this view, the lower end of the latch strap 64 may be pulled downwardly and outwardly to release the latch strap 64 and aperture 65 from the catch 66.

In this view, the lid grip 93 is also shown extending outwardly, forward of the front surface of the base 12. The forward positioning of the latch strap 64 positions the aperture 65 in alignment with the catch 66. The aperture 60 is vertically aligned with the catch 66 both laterally and forwardly-rearwardly. As a result, when the locking latch 62 is stretched, the aperture 65 (FIG. 7) may be placed over the catch 66 to retain the lid 14 closed. In the alternative, were the lid grip 93 not extending outward, the locking latch 62 and/or the front surface of the cooler base 12 not recessed slightly, the catch 66 would not be vertically aligned with the latch strap 64.

Figure 9:
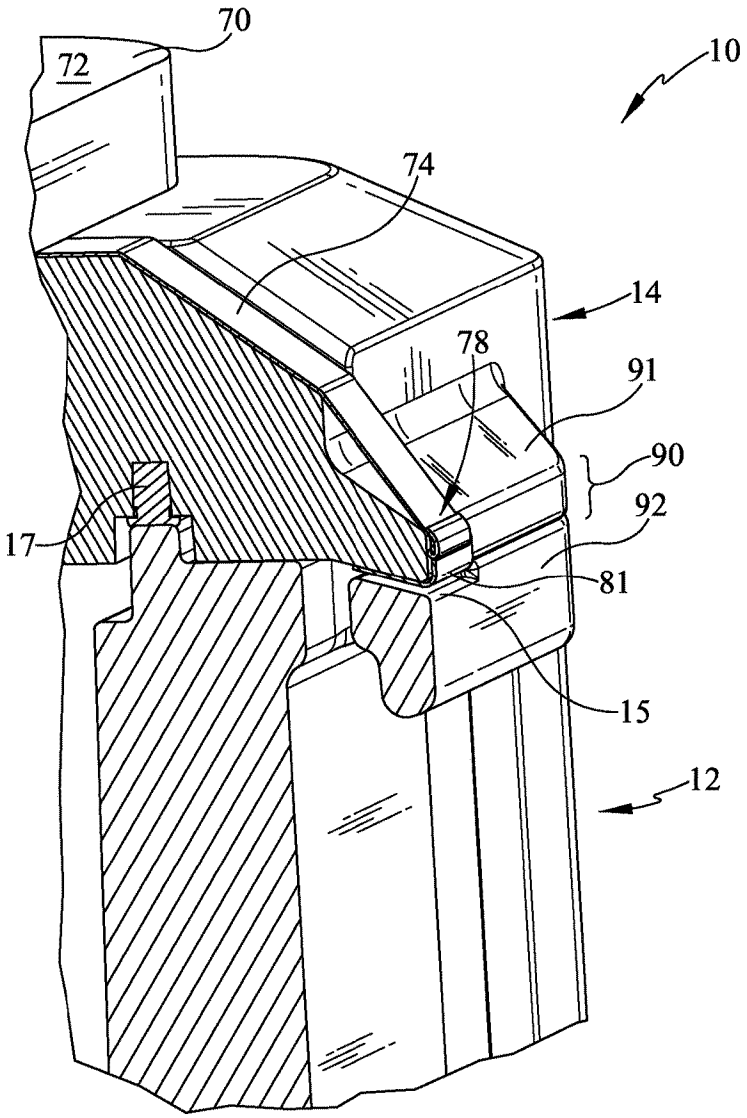
FIG. 9 is a section side view of the cushion strap engagement with the lid.

Referring now to FIG. 9, a section view of the cooler 10 is depicted. The section is lid 14 and the base 12 and more specifically through the handhold 90 and portions 91, 92. In this view, the cushion 70 is also shown having the at least one cushion strap 74. The at least one strap 74 may extend across the length of the cushion 70. The cushion 70 also comprises at least one strap 74 having a first end 76 (FIG. 2) and second end 78, or alternatively, may be comprised of two straps 74 which are connected near lateral ends of the cushion 70. The strap 74 includes a claw 81 which is shown in FIG. 9 and may also have a claw 79 (FIG. 2) at the other side of the cushion 70. The claws 79, 81 extend under the lid 14 and are captured therein when the lid 14 is closed. The claws 79, 81 engage the lid 14 or the base 12 when the lid 14 is closed so as to retain the cushion 70 on the lid 14 for seating. The claws 79, 81 and the at least one strap 74 also inhibit the cushion 70 from sliding off of the top lid 14. The claws 79, 81 are shown generally as L-shaped but may be other shapes which engage with one or both of the lid 14 and base 12 to retain the cushion in position. For non-limiting examples, J-shaped or C-shaped claws may be utilized. The strap 74 may be sewn together to provide a loop where the claw 81 is located. Other types of connections may be utilized.

As depicted, the lid 14 engages the base 12 when the lid 14 is closed. At least one of the lid 14 and the base 12 may include a cut or relief 15 providing space for the claws 79, 81 to extend there through. Once positioned therein, the claws 79, 81 are captured in position under the lid 14 and by the base 12, below.

The cushion 70 includes a cover 72 for a foam or soft padded material to provide some comfort when seated upon. The lid 14 may also be formed with an indention 83 (FIG. 1) which matches the shape of the cushion 70 so as to also aid the cushion 70 from sliding relative to the lid 14.

As also shown in the view, the seal 17 which may be formed on an edge of the base 12 to engage the lid 14 when the lid 14 closes or alternatively, the seal 17 may be positioned on the lid 14 to engage the base 12 when the lid 14 closes. As depicted, in some embodiments, the seal 17 may be formed on a rib or plateau which is raised relative to the remainder of the upper surface of the base 12. Still further, the lid 14 has a corresponding recess to receive the seal 17. Alternatively, such rib may be formed on the lid 14 and the seal 17 placed thereon, or on the base 12.

Figure 10:
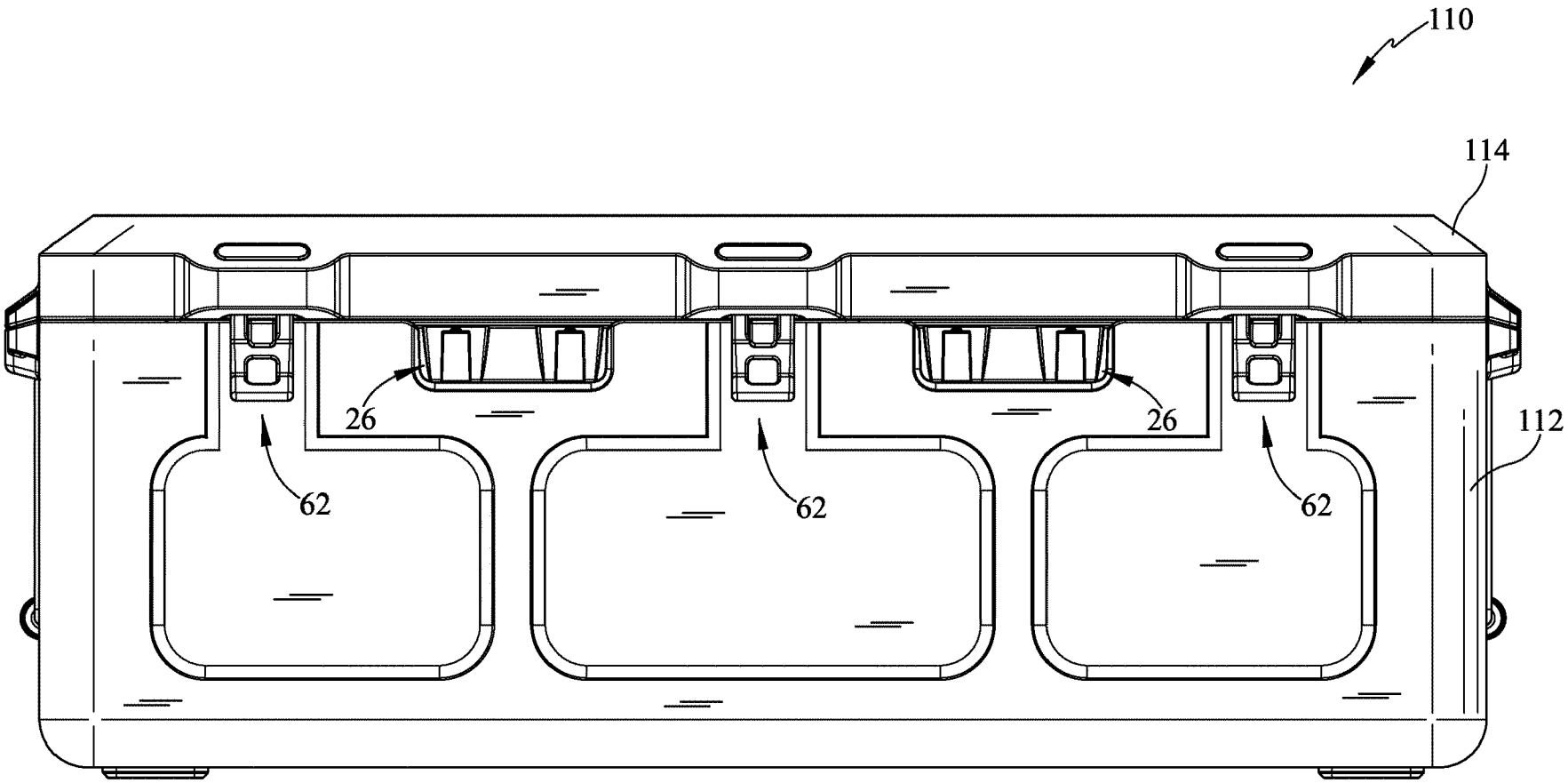
FIG. 10 is a an alternative embodiment of a cooler which has additional mounting locations for accessories.

Referring now to FIG. 10, a further embodiment is depicted in a front elevation view. In this embodiment, the cooler 110 is of a larger size in a lateral or side-to-side direction having larger base 112 and larger lid 114. As a result, the front surface is longer. In this embodiment, two accessory mounts 26 are shown. The length of the cooler 110 provides space for the accessory mounts 26 on both sides of a vertical center line of the cooler 110. Further, as shown, the length of the cooler 110 also allows for positioning of three latches 62. As previously described, the accessory mounts 26 and latches 62 may be formed on the front surface of the cooler 110 as shown, as well as on other surfaces of the cooler 110.

In still a further embodiment, and with reference to FIG. 11, a perspective view of the cooler 10 is shown with a further accessory 127. In this embodiment, the accessory 127 is a container or storage device which may be used to hold or store any of various items, such as keys, wallet, cell phone or the like. The container accessory 127 may be connected at one or two locations to the plate 50 (FIG. 4), described in previous embodiments or may be placed on the accessory rail 150 (FIG. 5). Alternatively, the container accessory 127 may be formed integrally with the plate 50 depending on anticipated loading of the container 127. The container 127 may have at least one relief 127*a*, which allows for drainage of fluids as well as some flexing to allow slightly oversized goods to be held and additionally, may provide a retaining spring force against any products being held therein. In this embodiment, for example, two reliefs 127*a* are shown.

Referring now to FIGS. 12 and 13, alternative embodiments of a handle 130 is depicted on the cooler 10. In the embodiments, the alternate handle 130 is shown first in an assembled view and secondly in an exploded view. The perspective view of FIG. 12 depicts the handle 130 having a rigid loop 131 which is mounted to an exterior loop mount 133 on the exterior side 16 of the cooler 10. As shown in FIG. 13, the exterior loop mount 133 includes a receiver 134 having a channel 135 which receives a portion of the loop 131. The receiver 134 may be integrally molded with the base 12 or may be fastened to the base 12. The receiver 134 also has an upper edge which is spaced from base 12 and provides a location wherein a cover 136 may be positioned to locate the cover 136 relative to the receiver 134. The cover 136 may have an opposing channel 137 to accommodate the opposite side of a portion of the loop 133. An upper edge of the cover 136 may be positioned within and behind the upper edge of the receiver 134. Once the upper edge of the cover 136 is positioned therein, the cover 136 pivots downwardly so that the channel 137 is positioned over the loop 131 and captures the loop 131 in the receiver channel 134, as well as the cover channel 137.

The cover 136 may also have one or more fastener aperture 138 which extend through the cover 136 and may receive fasteners extending into the base 12. The fasteners may be screws, rivets or other retaining structures to retain the handle 130 on the base 12.

Also shown depending from the cover 136 is a tie down hook 139. The hook 139 allows for a cord, strap, bungee or other tie-down to engage the cooler 10. The hook 139 is shown disposed on the cover 136 but alternatively may be integrally formed on the side 16 of the base 12.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A cooler with accessory system, comprising:

a cooler base;

at least one cooler lid pivotally mounted relative to said cooler base;

a lid grip disposed on said at least one cooler lid and overhanging a front surface of said cooler base, a latch aperture in said lid grip;

a latch strap depending through said latch aperture of said lid grip;

a catch disposed on said cooler base and engaged by an aperture of said latch strap to retain the at least one cooler lid in a closed position;

a recess centrally disposed in a vertical surface of at least one of said cooler base or said at least one cooler lid and adjacent to an interface between said at least one cooler lid and said cooler base;

an undercut slot formed within said recess and accessible when said at least one cooler lid is pivoted open from said cooler base so that an accessory mount is slidably positioned in said undercut slot;

an accessory connected to said accessory mount, wherein said accessory mount is located in the recess of the at least one of said cooler base or said at least one cooler lid.

2. The cooler of claim 1, wherein said recess provides a hand lift for opening said at least one cooler lid.

3. The cooler of claim 1, wherein said recess is disposed in both of said cooler base and said at least one cooler lid.

4. The cooler of claim 1, further comprising said undercut slot disposed within said recess adjacent to an edge of said recess.

5. The cooler of claim 4, wherein said undercut slot is disposed along at least two sides of said recess.

6. The cooler of claim 4, wherein said accessory mount is slidably received in said undercut slot when said at least one cooler lid is open.

7. The cooler of claim 4, wherein said recess receives said accessory mount and is retained in part by said at least one cooler lid.

8. The cooler of claim 4, wherein said undercut slot is oriented vertically in said cooler base.

9. The cooler of claim 1, wherein said recess is located in a forward facing surface of said cooler.

10. The cooler of claim 1, wherein said recess is formed in a surface other than a forward facing surface of said cooler.

11. The cooler of claim 1, wherein said accessory mount has one of a receiver or a grasp.

12. The cooler of claim 11, wherein said accessory has the other of said receiver or said grasp.

13. The cooler of claim 1, wherein said accessory mount has mounting positions for multiple accessories.

14. The cooler of claim 13, further comprising a rail for mounting multiple additional accessories.

15. The cooler of claim 1, said accessory being a drink holder.

16. The cooler of claim 1, said accessory being a post holder.

17. The cooler of claim 1, said accessory being a container.

18. The cooler of claim 1 further comprising a handhold disposed on said cooler base.

19. The cooler of claim 1, further comprising a handle assembly.

20. The cooler of claim 19, wherein said handle assembly comprises a handle loop and a cover.

21. The cooler of claim 20, said cover further comprising a tie-down hook.

22. The cooler of claim 18, further comprising a handle depending from said handhold.

* * * * *